US012669276B2

(12) United States Patent
Guan et al.

(10) Patent No.: US 12,669,276 B2
(45) Date of Patent: Jun. 30, 2026

(54) MOBILE COOLING BOX WITH ICE MAKER

(71) Applicant: Dometic Sweden AB, Solna (SE)

(72) Inventors: Weixian Guan, Zhuhai (CN); Peng Wang, Zhuhai (CN); Feng Wang, Zhuhai (CN)

(73) Assignee: Dometic Sweden AB, Solna (SE)

( * ) Notice: Subject to any disclaimer, the term of this patent is extended or adjusted under 35 U.S.C. 154(b) by 149 days.

(21) Appl. No.: 18/796,559

(22) Filed: Aug. 7, 2024

(65) Prior Publication Data

US 2024/0393026 A1 Nov. 28, 2024

Related U.S. Application Data

(63) Continuation of application No. 18/464,742, filed on Sep. 11, 2023, now Pat. No. 12,111,086, which is a continuation of application No. 17/825,374, filed on May 26, 2022, now Pat. No. 11,754,332, which is a continuation of application No. 16/728,715, filed on Dec. 27, 2019, now Pat. No. 11,359,848.

(30) Foreign Application Priority Data

Jan. 4, 2019 (DE) ..... 102019200067.3

(51) Int. Cl.
*F25C 1/00* (2006.01)
*F25D 11/00* (2006.01)

(52) U.S. Cl.
CPC ..... *F25C 1/00* (2013.01); *F25D 11/003* (2013.01); *F25C 2400/10* (2013.01)

(58) Field of Classification Search
CPC .... F25C 1/00; F25C 2400/10; F25C 2400/02; F25C 1/24; F25C 1/04; F25D 11/003; F25D 19/003; F25D 23/068; F25D 25/02; F25D 2303/0845
See application file for complete search history.

(56) References Cited

U.S. PATENT DOCUMENTS

| | | | |
|---|---|---|---|
| 1,691,468 | A | 11/1928 | Cooper et al. |
| 2,012,800 | A | 8/1935 | Allen |
| 2,492,601 | A | 12/1949 | Steel |
| 2,642,728 | A | 6/1953 | Thomaras |
| 2,715,817 | A | 8/1955 | M.Brodheim |
| 2,766,901 | A | 10/1956 | Sunko |
| 2,926,504 | A | 3/1960 | Hellinger |
| 3,035,733 | A | 5/1962 | Knapp |
| 3,338,068 | A | 8/1967 | Piker |
| 3,796,063 | A | 3/1974 | Wulke et al. |
| 3,938,694 | A | 2/1976 | Archuleta |
| 3,979,007 | A | 9/1976 | Thornbloom, Jr. |

(Continued)

FOREIGN PATENT DOCUMENTS

| | | |
|---|---|---|
| AU | 201712770 | 5/2017 |
| AU | 201712777 | 5/2017 |

(Continued)

OTHER PUBLICATIONS

US D935,281 S, 11/2021, Thelin et al. (withdrawn)

(Continued)

*Primary Examiner* — Elizabeth J Martin
(74) *Attorney, Agent, or Firm* — Dinsmore & Shohl LLP

(57) ABSTRACT

The present embodiments relate to an improved mobile cooling box with an ice maker that is capable of freezing water and making ice, for example, ice cubes.

14 Claims, 17 Drawing Sheets

(56) References Cited

U.S. PATENT DOCUMENTS

| | | | |
|---|---|---|---|
| 4,162,029 | A | 7/1979 | Esch et al. |
| D255,312 | S | 6/1980 | Uyeda |
| D256,587 | S | 8/1980 | Tatsumi |
| 4,326,383 | A | 4/1982 | Reed et al. |
| 4,328,676 | A | 5/1982 | Reed |
| 4,351,165 | A | 9/1982 | Gottsegen et al. |
| 4,468,932 | A | 9/1984 | Bullard |
| 4,757,920 | A | 7/1988 | Harootian, Jr. et al. |
| 4,802,344 | A | 2/1989 | Livingston et al. |
| 4,866,945 | A | 9/1989 | Bender et al. |
| 4,886,176 | A | 12/1989 | Steakley |
| 5,024,471 | A | 6/1991 | Kahl et al. |
| 5,301,508 | A | 4/1994 | Kahl et al. |
| 5,319,937 | A | 6/1994 | Fritsch et al. |
| D349,007 | S | 7/1994 | Costello |
| 5,407,218 | A | 4/1995 | Jackson |
| 5,676,296 | A | 10/1997 | Masters |
| 5,860,281 | A | 1/1999 | Coffee et al. |
| 5,897,435 | A | 4/1999 | Thomas et al. |
| 6,027,249 | A | 2/2000 | Bielinski |
| 6,308,518 | B1 | 10/2001 | Hunter |
| 6,349,845 | B1 | 2/2002 | Duncan |
| 6,354,101 | B1 | 3/2002 | Levitin et al. |
| 6,354,104 | B1 | 3/2002 | Feagin |
| 6,474,097 | B2 | 11/2002 | Treppedi et al. |
| D497,517 | S | 10/2004 | Reuter |
| D500,057 | S | 12/2004 | Reuter |
| 6,964,447 | B2 | 11/2005 | McNamee |
| D516,099 | S | 2/2006 | Maruyama |
| 7,143,601 | B1 | 12/2006 | Jimenez |
| D534,771 | S | 1/2007 | Zorn |
| 7,178,673 | B1 | 2/2007 | Miller |
| 7,415,794 | B1 | 8/2008 | Thompson |
| 7,617,699 | B1 | 11/2009 | Parmely |
| 7,913,849 | B2 | 3/2011 | Pedrazzi et al. |
| D640,102 | S | 6/2011 | Hawkins |
| 8,210,819 | B2 | 7/2012 | Wiebe et al. |
| 8,312,816 | B2 | 11/2012 | Vaccarella |
| D712,720 | S | 9/2014 | Seiders |
| D712,721 | S | 9/2014 | Seiders |
| D712,722 | S | 9/2014 | Seiders |
| D712,723 | S | 9/2014 | Seiders |
| D714,125 | S | 9/2014 | Seiders |
| 8,827,109 | B1 | 9/2014 | Sheehan |
| 8,910,819 | B2 | 12/2014 | Seiders |
| D722,474 | S | 2/2015 | Seiders |
| D722,475 | S | 2/2015 | Seiders |
| D732,348 | S | 6/2015 | Seiders et al. |
| D732,349 | S | 6/2015 | Seiders et al. |
| D732,350 | S | 6/2015 | Seiders et al. |
| D732,899 | S | 6/2015 | Seiders et al. |
| 9,137,232 | B2 | 9/2015 | Eschbatch et al. |
| 9,139,352 | B2 | 9/2015 | Seiders et al. |
| 9,163,871 | B1 | 10/2015 | Costello |
| 9,187,232 | B2 | 11/2015 | Seiders |
| 9,220,250 | B1 | 12/2015 | Davis, Sr. |
| 9,232,290 | B2 | 1/2016 | Besay |
| D752,347 | S | 3/2016 | Seiders et al. |
| 9,282,797 | B1 | 3/2016 | Soto |
| 9,320,938 | B1 | 4/2016 | Belmore |
| D792,486 | S | 7/2017 | Li |
| D802,028 | S | 11/2017 | Li |
| D802,029 | S | 11/2017 | Li |
| D802,630 | S | 11/2017 | Li |
| 9,951,986 | B1 | 4/2018 | Turner |
| 9,982,894 | B1 | 5/2018 | Philip et al. |
| D820,049 | S | 6/2018 | Ahlstrom |
| D836,993 | S | 1/2019 | Meda |
| D836,994 | S | 1/2019 | Meda |
| D844,386 | S | 4/2019 | Ahlstrom |
| D887,788 | S | 6/2020 | Meda |
| D888,503 | S | 6/2020 | Meda |
| 10,717,499 | B1 | 7/2020 | Street et al. |
| D894,043 | S | 8/2020 | Meda |
| D901,986 | S | 11/2020 | Meda |
| D920,743 | S | 6/2021 | Meda et al. |
| D927,938 | S | 8/2021 | Meda et al. |
| D929,471 | S | 8/2021 | Meda et al. |
| D935,280 | S | 11/2021 | Thelin et al. |
| D954,764 | S | 6/2022 | Meda et al. |
| 11,396,406 | B2 | 7/2022 | Guan et al. |
| 11,415,355 | B2 | 8/2022 | Thelin et al. |
| 2001/0039807 | A1 | 11/2001 | Mogil |
| 2002/0095947 | A1 | 7/2002 | Treppedi et al. |
| 2003/0019873 | A1 | 1/2003 | Nam et al. |
| 2003/0042266 | A1 | 3/2003 | Young et al. |
| 2003/0106895 | A1 | 6/2003 | Kalal |
| 2004/0178208 | A1 | 9/2004 | Leba et al. |
| 2004/0195793 | A1 | 10/2004 | Sullivan et al. |
| 2005/0274726 | A1 | 12/2005 | Boggs et al. |
| 2005/0279123 | A1 | 12/2005 | Maldonado et al. |
| 2005/0279750 | A1 | 12/2005 | Barquist et al. |
| 2007/0101754 | A1 | 5/2007 | Maldonado |
| 2007/0125100 | A1 | 6/2007 | Shoenfeld |
| 2008/0011759 | A1 | 1/2008 | Hsu |
| 2009/0126419 | A1 | 5/2009 | Yoon et al. |
| 2010/0251730 | A1 | 10/2010 | Whillock |
| 2011/0226785 | A1 | 9/2011 | Sakell |
| 2013/0068776 | A1 | 3/2013 | Patterson |
| 2013/0334238 | A1 | 12/2013 | Goforth |
| 2014/0216098 | A1 | 8/2014 | Heinrich et al. |
| 2015/0008242 | A1 | 1/2015 | Kpabar, Jr. |
| 2015/0021106 | A1 | 1/2015 | LaRosa |
| 2015/0114024 | A1 | 4/2015 | Grepper |
| 2015/0241107 | A1 | 8/2015 | Mech |
| 2015/0322698 | A1 | 11/2015 | Seiders |
| 2015/0353263 | A1 | 12/2015 | Seiders et al. |
| 2016/0101924 | A1 | 4/2016 | Mitchell et al. |
| 2016/0187046 | A1 | 6/2016 | Chen et al. |
| 2017/0023290 | A1 | 1/2017 | DeMuth |
| 2017/0108253 | A1 | 4/2017 | Monroy |
| 2017/0254578 | A1 | 9/2017 | Kriesel |
| 2018/0015938 | A1 | 1/2018 | Defrancia |
| 2018/0100682 | A1 | 4/2018 | Nilsen |
| 2018/0141718 | A1 | 5/2018 | Ahlstrom |
| 2018/0147913 | A1 | 5/2018 | Bergin |
| 2018/0201432 | A1 | 7/2018 | Harding |
| 2018/0306479 | A1 | 10/2018 | Vazquez |
| 2019/0161240 | A1 | 5/2019 | Ahlstrom |
| 2019/0308795 | A1 | 10/2019 | Juneau |
| 2020/0062454 | A1 | 2/2020 | Duong et al. |
| 2020/0216229 | A1 | 7/2020 | Weixian |
| 2020/0217571 | A1 | 7/2020 | Guan |
| 2020/0217574 | A1 | 7/2020 | Thelin |
| 2020/0217575 | A1 | 7/2020 | Thelin |
| 2020/0217576 | A1 | 7/2020 | Weixian |
| 2020/0217578 | A1 | 7/2020 | Wang |
| 2022/0355984 | A1 | 11/2022 | Guan et al. |
| 2023/0408164 | A1 | 12/2023 | Tang et al. |
| 2023/0417468 | A1 | 12/2023 | Guan et al. |

FOREIGN PATENT DOCUMENTS

| | | |
|---|---|---|
| AU | 201712780 | 5/2017 |
| AU | 201712782 | 5/2017 |
| AU | 201712791 | 5/2017 |
| AU | 201712799 | 5/2017 |
| AU | 201712802 | 5/2017 |
| AU | 201712803 | 5/2017 |
| AU | 201712785 | 7/2017 |
| AU | 201716789 | 11/2017 |
| AU | 201716791 | 11/2017 |
| AU | 201717667 | 1/2018 |
| AU | 201717669 | 1/2018 |
| AU | 201717670 | 1/2018 |
| AU | 201717674 | 1/2018 |
| AU | 201717676 | 1/2018 |
| AU | 201717662 | 2/2018 |
| AU | 201816061 | 1/2019 |
| AU | 201910011 | 2/2019 |
| AU | 201913598 | 8/2019 |
| AU | 201913601 | 8/2019 |
| AU | 201913603 | 8/2019 |
| AU | 201913604 | 8/2019 |

(56) References Cited

FOREIGN PATENT DOCUMENTS

| | | | |
|---|---|---|---|
| AU | 201913607 | | 8/2019 |
| AU | 201913624 | | 8/2019 |
| AU | 201913626 | | 8/2019 |
| AU | 201913627 | | 8/2019 |
| AU | 201913631 | | 8/2019 |
| AU | 201913633 | | 8/2019 |
| AU | 202012545 | | 6/2020 |
| AU | 202012548 | | 6/2020 |
| AU | 2019284128 | | 7/2020 |
| AU | 2019284129 | | 7/2020 |
| AU | 2019284130 | | 7/2020 |
| AU | 2019284131 | | 7/2020 |
| AU | 2019284133 | | 7/2020 |
| AU | 2019284134 | | 7/2020 |
| CN | 1888356 | A | 1/2007 |
| CN | 101074057 | A | 11/2007 |
| CN | 101208568 | A | 6/2008 |
| CN | 206488529 | U | 9/2017 |
| CN | 107804580 | A | 3/2018 |
| CN | 207081259 | U | 3/2018 |
| CN | 208312853 | U | 1/2019 |
| CN | 208499239 | U | 2/2019 |
| CN | 106233083 | | 7/2019 |
| CN | 305240920 | S | 7/2019 |
| CN | 110191654 | | 8/2019 |
| CN | 209893773 | U | 1/2020 |
| CN | 305553099 | | 1/2020 |
| CN | 305751278 | | 5/2020 |
| CN | 306079204 | | 9/2020 |
| DE | 666767 | C | 10/1938 |
| DE | 20110247 | | 12/2002 |
| DE | 202004010081 | | 9/2004 |
| DE | 19981898 | B3 | 7/2005 |
| DE | 202007001638 | | 5/2007 |
| DE | 202009015164 | | 3/2010 |
| DE | 102011100722 | U1 | 11/2012 |
| DE | 202014000386 | U1 | 4/2014 |
| DE | 202013007655 | | 1/2015 |
| DE | 102014221784 | A1 | 4/2016 |
| DE | 102019200065 | | 1/2019 |
| DE | 102019200067 | | 1/2019 |
| DE | 102019200068 | | 1/2019 |
| DE | 102019200070 | | 1/2019 |
| DE | 112017005901 | | 8/2019 |
| DE | 102019200063 | | 7/2020 |
| DE | 102019200064 | | 7/2020 |
| EP | 1000577 | A1 | 5/2000 |
| EP | 2772704 | A1 | 9/2014 |
| EP | 005230802-001 | | 4/2018 |
| EP | 005230802-002 | | 4/2018 |
| EP | 001470413-0001-02 | | 1/2019 |
| EP | 005948601-0001-30 | | 1/2019 |
| GB | 432256 | A | 7/1935 |
| GB | 2419177 | A | 4/2006 |
| JP | H1194417 | A | 4/1999 |
| JP | 4362188 | B2 | 11/2009 |
| KR | 1020050042093 | A | 5/2005 |
| WO | 9936324 | A1 | 7/1999 |
| WO | 2014131679 | A1 | 9/2014 |
| WO | 2017071654 | A1 | 5/2017 |
| WO | 2018095957 | | 5/2018 |
| WO | 2018231826 | A1 | 12/2018 |
| WO | 2018233611 | A1 | 12/2018 |
| WO | 2019206219 | A1 | 10/2019 |

OTHER PUBLICATIONS

Corrected Notice of Allowance Issued in U.S. Appl. No. 29/711,905 mailed on Sep. 24, 2021.
Corrected Notice of Allowance Issued in U.S. Appl. No. 29/711,906 mailed on Sep. 24, 2021.
Non Final Office Action Issued in U.S. Appl. No. 16/728,604 mailed on Oct. 25, 2021.
Non Final Office Action Issued in U.S. Appl. No. 16/728,657 mailed on Nov. 15, 2021.
Notice of Allowance Issued in U.S. Appl. No. 29/785,568 mailed on Nov. 16, 2021.
Seriously impressive portable refrigerators by Dometic at SEMA 2018 [viewed on internet on Jul. 29, 2025] https://www.youtube.com/watch?v=DoJ-naBswbl.
Unboxing Dometic CFX95DZW Fridge First Impressions E008 [viewed on internet on Jul. 29, 2025] https://www.youtube.com/watch?v=UGqITOsnsxM.
Whynter Portable Fridge / Freezer Featuring FM-65G and FM-62DZ [viewed on internet on Jul. 29, 2025] https://www.youtube.com/watch?v=1KoNKpDJUY4.
Whynter 65g Portable Fridge/Freezer review [viewed on internet on Jul. 29, 2025] https://www.youtube.com/watch?v=UOONTsens7Q.
Koldfront 43 Quart 12V DC Portable Fridge Freezer—KF430 [viewed on internet on Jul. 29, 2025] https://www.youtube.com/watch?v=dCmfvljhcIQ.
United Kingdom Application No. 6157655 titled "Mini Fridge" filed on Aug. 27, 2021.
United Kingdom Application No. 6157656 titled "Mini Fridge" filed on Aug. 27, 2021.
United Kingdom Application No. 6157637 titled "Mini Fridge" filed on Aug. 27, 2021.
United Kingdom Application No. 6157638 titled "Mini Fridge" filed on Aug. 27, 2021.
United Kingdom Application No. 6157639 titled "Mini Fridge" filed on Aug. 27, 2021.
United Kingdom Application No. 6157640 titled "Mini Fridge" filed on Aug. 27, 2021.
United Kingdom Application No. 6157641 titled "Mini Fridge" filed on Aug. 27, 2021.
United Kingdom Application No. 6157642 titled "Mini Fridge" filed on Aug. 27, 2021.
United Kingdom Application No. 6157643 titled "Mini Fridge" filed on Aug. 27, 2021.
United Kingdom Application No. 6157644 titled "Mini Fridge" filed on Aug. 27, 2021.
United Kingdom Application No. 6157645 titled "Mini Fridge" filed on Aug. 27, 2021.
United Kingdom Application No. 6157646 titled "Mini Fridge" filed on Aug. 27, 2021.
United Kingdom Application No. 6157647 titled "Mini Fridge" filed on Aug. 27, 2021.
United Kingdom Application No. 6157648 titled "Mini Fridge" filed on Aug. 27, 2021.
United Kingdom Application No. 6157649 titled "Mini Fridge" filed on Aug. 27, 2021.
United Kingdom Application No. 6157650 titled "Mini Fridge" filed on Aug. 27, 2021.
United Kingdom Application No. 6157651 titled "Mini Fridge" filed on Aug. 27, 2021.
United Kingdom Application No. 6157652 titled "Mini Fridge" filed on Aug. 27, 2021.
United Kingdom Application No. 6157653 titled "Mini Fridge" filed on Aug. 27, 2021.
United Kingdom Application No. 6157654 titled "Mini Fridge" filed on Aug. 27, 2021.
Corrected Notice of Allowance Issued in U.S. Appl. No. 29/785,568 mailed on Dec. 6, 2021.
Office Action Issued in German Patent Application No. 102019200070.3 mailed on Aug. 25, 2021.
Office Action Issued in U.S. Appl. No. 16/728,646 mailed on Dec. 21, 2021.
Decision to Grant mailed in DE Patent Application No. 1020192000681 on Oct. 15, 2020.
Examination report mailed in DE Application No. 102019200065.7 on Sep. 30, 2019.
Examination report mailed in DE Application No. 102019200068.1 on Oct. 8, 2019.
DE Patent application 102020209896.4 entitled "Handle Module" filed on Aug. 5, 2020.

(56) References Cited

OTHER PUBLICATIONS

Decision to Grant mailed in DE Patent Application No. 102019200065.7 on Aug. 4, 2020.
Corrected Notice of Allowance Issued in U.S. Appl. No. 29/697,069 mailed on Feb. 26, 2021.
Notice of Allowance Issued in U.S. Appl. No. 29/711,906 mailed on Feb. 7, 2022.
Notice of Allowance Issued in U.S. Appl. No. 29/785,568 mailed on Feb. 8, 2022.
Decision to Grant Issued in German Application No. 102019200070.3 mailed on Mar. 2, 2022.
Supplemental Notice of Allowance Issued in U.S. Appl. No. 29/711,906 mailed on Mar. 10, 2022.
Corrected Notice of Allowance Issued in U.S. Appl. No. 29/785,568 mailed on Mar. 9, 2022.
Notice of Allowance Issued in U.S. Appl. No. 16/728,657 mailed on Mar. 9, 2022.
Notice of Allowance Issued in U.S. Appl. No. 16/728,604 mailed on Apr. 13, 2022.
United States Patent Office, Notice of Allowance in U.S. Appl. No. 29/697,070 dated Apr. 28, 2021.
Notice of Allowance Issued in U.S. Appl. No. 29/697,071 mailed on Apr. 12, 2021.
Decision to Grant Issued in German Application No. 102020209896.4 mailed on Jan. 10, 2023.
Final Office Action Issued in U.S. Appl. No. 16/800,512 mailed on Feb. 14, 2023.
Notice of Allowability Issued in U.S. Appl. No. 16/728,646 mailed on Feb. 15, 2023.
Non-Final Office Action issued in U.S. Appl. No. 16/728,687 mailed on Mar. 17, 2023.
Ex-Parte Quayle Action issued in U.S. Appl. No. 17/872,514 mailed on May 5, 2023.
Patent Certificate issued in DE Patent Application No. 102020209896.4 mailed on Apr. 20, 2023.
Amazon.com, ICECO insulated protective cover, first date available Oct. 11, 2019. (Year: 2019), pp. 1-2.
Corrected Notice of Allowance Issued in U.S. Appl. No. 29/697,070 mailed on May 19, 2021.
Corrected Notice of Allowance Issued in U.S. Appl. No. 29/697,071 mailed on Jun. 3, 2021.
Corrected Notice of Allowance Issued in U.S. Appl. No. 29/697,070 mailed on Jun. 3, 2021.
Corrected Notice of Allowance Issued in U.S. Appl. No. 29/697,070 mailed on Jun. 9, 2021.
Corrected Notice of Allowance Issued in U.S. Appl. No. 29/697,071 mailed on Jun. 9, 2021.
Corrected Notice of Allowance Issued in U.S. Appl. No. 29/711,905 mailed on Aug. 11, 2021.
Corrected Notice of Allowance Issued in U.S. Appl. No. 29/711,906 mailed on Aug. 11, 2021.
Examination Report Issued for DE Application No. 102020209896.4 mailed on Apr. 19, 2021.
Notice of Allowance Issued in U.S. Appl. No. 29/711,905 mailed on Jul. 12, 2021.
Notice of Allowance Issued in U.S. Appl. No. 29/711,906 mailed on Jul. 12, 2021.
Restriction Requirement Issued in U.S. Appl. No. 16/728,623 mailed on Aug. 30, 2021.
Design U.S. Appl. No. 29/785,568, filed May 26, 2021 titled "Cooler Fender Frame".
Design U.S. Appl. No. 29/803,817 titled "Fender Frame, Internal Closure, and Hinge of a Cooler" filed on Aug. 16, 2021.
AU Patent Application No. 2025202208 entitled "Mobile cooling box with ice maker" filed Mar. 27, 2025.
Final Office Action Issued in U.S. Appl. No. 16/728,623 mailed on May 19, 2023.
Non-Final Office Action issued in U.S. Appl. No. 17/886,803 mailed on May 23, 2023.
Restriction Requirement for Design U.S. Appl. No. 29/697,070 mailed on Dec. 28, 2020.
Notice of Allowance Issued in U.S. Appl. No. 29/697,071 mailed on Dec. 23, 2020.
Examination report mailed in EU Design Application No. 005948601-0001/005948601-0030 on Jan. 9, 2019.
Examination report mailed in DE Patent Application No. 102019200070.3 on Sep. 24, 2019.
Examination report mailed in DE Patent Application No. 102019200064.9 on Sep. 27, 2019.
Examination report mailed in DE Patent Application No. 102019200067.3 on Oct. 8, 2019.
Examination report mailed in DE Patent Application No. 102019200063.0 on Oct. 15, 2019.
Notification to Grant Patent Right for CN Design Application No. 201930331393.8 Mailed on Oct. 29, 2019.
CN Design application No. 201930331393.8 entitled " Cooler" filed on Jun. 25, 2019.
CN Patent Application No. 201911066985.7 entitled "Cover for a Cooler" filed Nov. 4, 2019.
DE Design Application No. 102019200067.3 entitled "Mobile Cooling Box With Ice Maker" filed Jan. 4, 2019.
DE Patent Application No. 102019200063.0 entitled "Mobile Cooling Box with User Interface Module" filed Jan. 4, 2019.
DE Patent Application No. 102019200064.9 entitled "Mobile Cooling Box with Latch Handle Opening" filed Jan. 4, 2019.
DE Patent Application No. 102019200070.3 entitled "Mobile Cooling Box With Hinge Module" filed Jan. 4, 2019.
European Design Application No. 005948601 "Cooler" filed Jan. 4, 2019.
Design U.S. Appl. No. 29/666,264 entitled "Cooler" filed Oct. 11, 2018.
Design U.S. Appl. No. 29/650,910, filed Jun. 11, 2018 titled "Zipper Pull".
AU Patent Application No. 202012545 entitled "Cover for Cooler" filed May 1, 2020.
AU Patent Application No. 202012548 entitled "Cover for Cooler" filed Apr. 30, 2020.
European Design Application No. 007847777-0002 "CFX3 Protective covers" filed Apr. 30, 2020.
Decision to Grant mailed in DE Patent Application No. 102019200064.9 on Jul. 31, 2020.
Decision to Grant mailed in DE Patent Application No. 102019200063.0 on Aug. 4, 2020.
Restriction Requirement for Design U.S. Appl. No. 29/697,069 mailed on Sep. 24, 2020.
AU Patent Application No. 2019284133 entitled "Mobile cooling box with ice maker" filed Dec. 30, 2019.
AU Patent Application No. 2019284131 entitled "Mobile cooling box with hinge moduler" filed Dec. 30, 2019.
AU Patent Application No. 2019284128 entitled "Mobile cooling box with user interface moduler" filed Dec. 30, 2019.
AU Patent Application No. 2019284134 entitled "Mobile Cooling Box with Latch Handle Opening" filed Dec. 30, 2019.
Notice of Allowance Issued in U.S. Appl. No. 29/697,069 mailed on Feb. 1, 2021.
Design U.S. Appl. No. 29/585,279, filed Nov. 22, 2016 titled Latch.
Design U.S. Appl. No. 29/605,186, filed May 24, 2017 filed titled Refrigerating Apparatus.
Design U.S. Appl. No. 29/650,906, filed Jun. 11, 2018 titled Soft Bag Cooler.
Design U.S. Appl. No. 29/670,885, filed Nov. 20, 2018 titled Cooler.
Design U.S. Appl. No. 29/670,888, filed Nov. 20, 2018 titled Cooler.
Design U.S. Appl. No. 29/697,069, filed Jul. 3, 2019 titled Cooler.
Design U.S. Appl. No. 29/697,070, filed Jul. 3, 2019 titled Cooler.
Design U.S. Appl. No. 29/697,071, filed Jul. 3, 2019 titled Cooler.
Design U.S. Appl. No. 29/708,155, filed Oct. 3, 2019 titled Latch.
Design U.S. Appl. No. 29/708,156, filed Oct. 3, 2019 titled Latch.
Design U.S. Appl. No. 29/711,905, filed Nov. 4, 2019 titled Cover for a Cooler.
Design U.S. Appl. No. 29/711,906, filed Nov. 4, 2019 titled Cover for a Cooler.

(56) References Cited

OTHER PUBLICATIONS

U.S. Appl. No. 16/728.646, filed Dec. 27, 2019 titled Mobile Cooling Box with Air Vents.
U.S. Appl. No. 16/728,604, filed Dec. 27, 2019 titled Mobile Cooling Box with Handle Module.
U.S. Appl. No. 16/728,657, filed Dec. 27, 2019 titled Mobile Cooling Box with Hinge Module.
U.S. Appl. No. 16/728,687, filed Dec. 27, 2019 titled Mobile Cooling Box with Latch Handle.
U.S. Appl. No. 16/728,623, filed Dec. 27, 2019 titled Mobile Cooling Box with User Interface Module.
U.S. Appl. No. 16/800,512, filed Feb. 25, 2020 titled Cover for a Cooler.
Design U.S. Appl. No. 29/743,180, filed Jul. 20, 2020 titled Cooler.
Dometic Product Catalog—Coolers; 2015.
Dometic Product Catalog—Coolers, 2016.
U.S. Appl. No. 16/728,715 entitled "Mobile cooling box with hinge module" filed on Dec. 27, 2019.
Non Final Office Action Issued in U.S. Appl. No. 16/728,715 mailed on May 19, 2021.
Final Office Action Issued in U.S. Appl. No. 16/728,715 mailed on Oct. 7, 2021.
Australian Patent Application No. 2020264299 entitled "Cover for a cooler" filed Nov. 4, 2020.
German Patent Application No. 102020213897.4 titled "Cover for a cooler" filed Nov. 4, 2020.
Notice of Allowance Issued in U.S. Appl. No. 16/728,715 mailed on Feb. 2, 2022.
Non Final Office Action Issued in U.S. Appl. No. 16/728,687 mailed on Apr. 15, 2022.
Corrected Notice of Allowance Issued in U.S. Appl. No. 16/728,715 mailed on Mar. 9, 2022.
Notice of Allowance Issued in U.S. Appl. No. 16/728,657 mailed on Mar. 24, 2022.
Corrected Notice of Allowance Issued in U.S. Appl. No. 16/728,715 mailed on Feb. 23, 2022.
Notice of Allowance Issued in U.S. Appl. No. 29/711,906 mailed on May 2, 2022.
Supplemental Notice of Allowance Issued in U.S. Appl. No. 16/728,657 mailed on May 2, 2022.
Supplemental Notice of Allowance Issued in U.S. Appl. No. 16/728,604 mailed on May 13, 2022.
Corrected Notice of Allowance Issued in U.S. Appl. No. 16/728,715 mailed on May 16, 2022.
Restriction Requirement Issued in U.S. Appl. No. 16/800,512 mailed on May 24, 2022.
Design U.S. Appl. No. 29/840,161 titled "Cooler Fender Frame" filed on May 26, 2022.
Non-Final Office Action Issued in U.S. Appl. No. 16/728,646 mailed on May 26, 2022.
Notice of Allowance Issued in U.S. Appl. No. 16/728,657 mailed on Jun. 15, 2022.
Corrected Notice of Allowability Issued in U.S. Appl. No. 16/728,604 mailed on Jul. 8, 2022.
U.S. Appl. No. 17/872,514 titled "Mobile Cooling Box with Ice Maker" filed on Jul. 25, 2022.
U.S. Appl. No. 17/886,803 titled "Mobile Cooling Box with Handle Module" filed on Aug. 12, 2022.
Non-Final Office Action Issued in U.S. Appl. No. 16/728,623 mailed on Oct. 3, 2022.
Non-Final Office Action Issued in U.S. Appl. No. 16/800,512 mailed on Oct. 11, 2022.
Notice of Allowance Issued in U.S. Appl. No. 16/728,646 mailed on Oct. 24, 2022.
Final Office Action Issued in U.S. Appl. No. 16/728,687 mailed on Nov. 28, 2022.
U.S. Appl. No. 17/825,374 titled "Mobile Cooling Box with Ice Maker" filed on May 26, 2022.
Non-Final Office Action issued in U.S. Appl. No. 17/825,374 mailed on Oct. 25, 2022.
Notice of Allowability issued in U.S. Appl. No. 17/825,374 mailed on Mar. 7, 2023.
Corrected Notice of Allowability issued in U.S. Appl. No. 17/825,374 mailed on Mar. 16, 2023.
Corrected Notice of Allowability issued in U.S. Appl. No. 16/728,646 mailed on Apr. 24, 2023.
Notice of Allowability issued in U.S. Appl. No. 17/825,374 mailed on Apr. 24, 2023.
Corrected Notice of Allowability issued in U.S. Appl. No. 17/825,374 mailed on Jun. 1, 2023.
Office Action issued in CN Application No. 201911066985.7 mailed on Jul. 26, 2023.
Notice of Allowability issued in U.S. Appl. No. 17/825,374 mailed on Jul. 26, 2023.
Notice of Allowability issued in U.S. Appl. No. 17/872,514 mailed on Jul. 21, 2023.
Restriction Requirement issued in U.S. Appl. No. 29/803,817 mailed on Aug. 15, 2023.
Corrected Notice of Allowability issued in U.S. Appl. No. 16/728,646 mailed on Aug. 31, 2023.
Supplemental Notice of Allowability issued in U.S. Appl. No. 17/872,514 mailed on Aug. 30, 2023.
Supplemental Notice of Allowability issued in U.S. Appl. No. 17/872,514 mailed on Sep. 13, 2023.
Final Office Action issued in U.S. Appl. No. 17/886,803 mailed on Oct. 10, 2023.
Corrected Notice of Allowability issued in U.S. Appl. No. 16/728,646 mailed on Oct. 4, 2023.
Supplemental Notice of Allowability issued in U.S. Appl. No. 17/872,514 mailed on Oct. 10, 2023.
Notice of Allowability issued in U.S. Appl. No. 16/728,687 mailed on Oct. 10, 2023.
Examination Report issued for AU Application No. 2019284129 mailed on Dec. 5, 2023.
U.S. Appl. No. 18/502,801 titled "Mobile Cooling Box with Hinge Module" filed on Nov. 6, 2023.
Notice of Allowance issued in U.S. Appl. No. 29/803,817 mailed on Dec. 6, 2023.
Corrected Notice of Allowability issued in U.S. Appl. No. 16/728,646 mailed on Oct. 25, 2023.
Notice of Acceptance issued in AU Application No. 2019284129 mailed on Jan. 8, 2024.
Notice of Allowability issued in U.S. Appl. No. 29/803,817 mailed on Jan. 18, 2024.
AU Application No. 2024200685 titled "Mobile cooking box with handle module" filed on Feb. 5, 2024.
U.S. Appl. No. 18/420,358 titled "Mobile Cooling Box with Latch Handle Opening" filed on Jan. 23, 2024.
Notice of Allowance issued in U.S. Appl. No. 29/803,817 mailed on Feb. 8, 2024.
Corrected Notice of Allowability issued in U.S. Appl. No. 29/840,161 mailed on Feb. 16, 2024.
Non-Final Office Action issued in U.S. Appl. No. 16/728,623 mailed on Mar. 14, 2024.
Corrected Notice of Allowance issued in U.S. Appl. No. 29/840,161 mailed on Mar. 14, 2024.
Notice of Allowance issued in U.S. Appl. No. 17/886,803 mailed on Mar. 20, 2024.
U.S. Appl. No. 29/933,756 titled "Internal Closure and Hinge of a Cooler" filed on Mar. 21, 2024.
U.S. Appl. No. 18/464,742 titled "Mobile Cooling Box with Ice Maker" filed on Sep. 11, 2023.
Office Action issued in CN Application No. 201911066985.7 mailed on Mar. 23, 2024.
Notice of Allowance issued in U.S. Appl. No. 18/464,742 mailed on Apr. 24, 2024.
Corrected Notice of Allowance issued in U.S. Appl. No. 29/840,161 mailed on May 1, 2024.
Corrected Notice of Allowance issued in U.S. Appl. No. 29/840,161 mailed on Apr. 18, 2024.
Corrected Notice of Allowance issued in U.S. Appl. No. 17/886,803 mailed on May 16, 2024.

(56) References Cited

OTHER PUBLICATIONS

Corrected Notice of Allowance issued in U.S. Appl. No. 18/464,742 mailed on May 15, 2024.
U.S. Appl. No. 18/751,707 titled "Mobile Cooling Box With Handle Module" filed on Jun. 24, 2024.
Office Action issued in CN Application No. 201911066985.7 mailed on Aug. 10, 2024.
Non-Final Office Action issued in U.S. Appl. No. 18/420,358 mailed on Aug. 16, 2024.
Corrected Notice of Allowance issued in U.S. Appl. No. 18/464,742 mailed on Sep. 5, 2024.
Examination Report No. 1 issued in AU Application No. 2019284130 mailed on Oct. 1, 2024.
Notice of Allowance issued in U.S. Appl. No. 16/728,623 mailed on Oct. 18, 2024.

MOBILE COOLING BOX WITH ICE MAKER

BACKGROUND

1. Field of the Invention

The present embodiments relate to an improved mobile cooling box with an ice maker that is capable of freezing water and making ice, for example, ice cubes.

2. Description of the Related Art

Mobile cooling boxes are well-known from the state of the art. Usually, a mobile cooling box comprises a thermo-isolated housing for storing the goods to be stored and cooled inside and a lid for allowing access to the inside to put into or remove the goods from the mobile cooling box. It is within the nature of mobile cooling boxes that such boxes are not stationary but are movable by the user. Typically, such mobile cooling boxes are used for any kind of non-stationary use, like for example during outdoor activities, camping, yachting or the like to store and cool goods like food, drinks or even medical products, etc. for a certain period of time.

Especially during hot summer time, it is quite favorable to have cooled beverages, for example at the beach or in a vehicle. Thus, mobile cooling boxes are used for this purpose. Furthermore, it is very popular to have as well frozen water or ice, like in form of ice cubes, to further cool beverages and drinks. However, usual mobile cooling boxes having an integrated electrically driven cooling unit are usually not capable of freezing water and making ice and/or keeping water frozen. However, usual mobile cooling boxes having an integrated electrically driven cooling unit are mostly not capable of making ice but rather of keeping ice frozen for a while. However, more powerful cooling boxes are known with which water can be frozen. However, this is in turn too cold for the beverages and, therefore, the user has to decide whether he or she wishes freezing or just cooling. Since having two separate boxes for freezing and cooling, respectively, is too cumbersome, there is the need for a more intelligent solution.

Especially from household applications, more powerful stationary cooling devices are known in the art providing a freezer with which water can be frozen while next to this a separate compartment for cooling is provided. However, by their nature, these stationary household cooling devices although being capable of producing ice are not capable of being moved around while working and/or being used in an outdoor area, for example at the beach or the like.

Hence, although there are in general possibilities available in the prior art for providing a freezer or ice maker function for stationary household cooling devices but also mobile cooling boxes, taking the above drawbacks of known ice maker configurations for mobile cooling boxes into account there is indeed room for improvements in this regard.

The information included in this Background section of the specification, including any references cited herein and any description or discussion thereof, is included for technical reference purposes only and is not to be regarded subject matter by which the scope of the invention is to be bound.

SUMMARY

The present embodiments, therefore, provide a mobile cooling box with which it is possible to freeze water and transport cooled goods as well as frozen goods, especially water.

The present embodiments provide a mobile cooling box having a box main body with inner side walls and a bottom, and at least one lid for opening the mobile cooling box and providing access, for example from above, to the inside of the mobile cooling box, wherein the inside of the mobile cooling box is laminated with a lining at the inner side walls and at the bottom.

According to some embodiments, the mobile cooling box has an ice maker module, and the ice maker module having a freezing compartment. The ice maker module can be removably placed in a freezing zone on a bottom part of the lining.

The mobile cooling box may further comprise an evaporator arranged underneath the bottom part of the lining at the freezing zone. The evaporator provides sufficient cooling power for freezing goods when being placed in the freezing zone, while at the same time providing sufficient cooling power to keep the remaining inside of the mobile cooling unit cooled at the predefined cooling temperature.

With the mobile cooling box of the present embodiments it is, thus, possible to transport cooled goods and frozen goods at the same time.

According to one embodiment of the mobile cooling box, the ice maker module may be an assembly of components and comprises basically a frame and a cover. The frame has lateral walls limiting the freezing compartment. The cover is attached to the upper side of the frame for opening and closing the ice maker module and providing access, for example from above, to the freezing compartment. Thereby, the freezing cold is reliably kept inside the freezing compartment.

According to one embodiment of the mobile cooling box, the freezing compartment is limited at its bottom by the lining at the freezing zone. Thus, no additional whatsoever ground plate or bottom plate is provided for the ice maker module which is cost-effective and furthermore increases the freezing efficiency.

According to one embodiment of the mobile cooling box, the freezing zone is rectangular in shape and is located in a niche limited by the lining of three of the inner side walls. Moreover, the ice maker module fits in the niche. Thereby, the ice maker module is held in place by the adjacent side walls.

According to one embodiment of the mobile cooling box, at least one pair of corresponding attachment means configured to releasably engage with each other is present at the lining of the inner side walls adjacent to the freezing zone and at the ice maker module, respectively. By the attachment means the position of the ice maker module is secured. This further ensures the position of the ice maker module. For example, one pair of said attachment means is provided at each one of two opposite sides of the ice maker module and the respective adjacent inner side wall, i.e. the lining thereof. In some embodiments in which the ice maker module is located in a niche, attachment means at two opposite sides of the ice maker module and the respective adjacent inner side walls are most preferred.

According to one embodiment of the mobile cooling box, the pair of attachment means provide for a form-locked connection. This ensures a secure connection. The specific kind of connection is not particularly limited. The form-fitting connection is a snap-in connection comprising a projecting element selected from the group consisting of hooks, noses and studs, that is configured to snap in a corresponding recess.

According to a further embodiment of the mobile cooling box, the projecting element may be present at the ice maker module and the recess may be present at the lining of an inner side wall. This eases the removal of the ice maker module from the mobile cooling box, for example, for cleaning purposes.

According to an embodiment of the mobile cooling box, the projecting element may be present at the frame of the ice maker module. This represents a very stable construction of the ice maker module.

According to one embodiment of the mobile cooling box, each attachment means of one pair of corresponding attachment means is formed as an integral part of the lining and the ice maker module, respectively. This reduces complexity and production costs, and further eases cleaning procedures.

According to one embodiment of the mobile cooling box, the cover may be hinged to the frame so as to be swingably openable to the above. This provides for a comfortable opening action for the user.

According to one embodiment of the mobile cooling box, the cover can be swung open about an angle of more than 90° from its closed position. Thereby, the cover can stay open by itself and, thus, loading and unloading of the freezing compartment is easier.

According to one embodiment of the mobile cooling box, the cover comprises a grip portion by means of which the cover can be opened and closed by the hand of a user. This increases comfort for the user.

According to one embodiment of the mobile cooling box, the ice maker module further comprises one or more ice trays that fit into the freezing compartment. Each of the ice trays may be equipped with a cap. Thereby, water can be turned into ice cubes and leaking out from the ice trays during transport of the mobile cooling box can be prevented.

According to a further embodiment of the mobile cooling box, the ice tray has a plurality of recesses for forming ice cubes and the cap has small holes enabling air exchange between inside and outside of the ice tray but predominantly preventing water from leaking out. In this way, the quality and esthetic appearance of the ice cubes produced can be increased. Preferably, one of small holes is present above each recess in the ice tray. The term small is not to be understood limiting in any way but is rather intended to give an idea about a suitable size of the holes. The size of the small holes may range between 0.10 mm and 0.50 mm, and further between 0.15 mm and 0.35 mm.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In the following, embodiments of the mobile cooling box are described in more detail with reference to the accompanying drawings, wherein.

DETAILED DESCRIPTION

Figure 1:
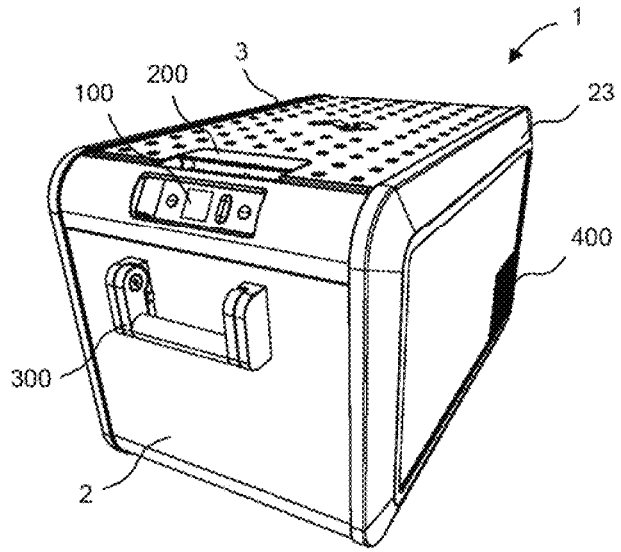
FIG. 1 shows a front perspective view of a mobile cooling box.

The illustrated mobile cooling boxes 1 in FIGS. 1 to 7 are essentially rectangular in shape. Basically, the mobile cooling boxes according to some embodiments have a box main body 2 and one or a plurality of lids, for example two lids 3 for opening the box 1 and providing access to the inside of the box 1. In the present case, access to the inside of the box 1 is possible from above, but is not limited thereto. The front edge of the lid 3 can be pivotally opened. The rear edge is hinged to the box main body 2. At its front and rear edges, the mobile cooling box 1 is rounded, while the side edges are covered and protected by a fender frame 23 that forms part of the box main body 2. The height of the fender frame 23 is equal to the level of the lid 3 when the mobile cooling box 1 is closed. Thus, the lid 3 when being closed sort of sinks or recesses between the two opposite fender frames 23 thus offering a smooth, uniform and robust look of the mobile cooling box.

In this context and within the framework of the present embodiments, but without limitation, all directional terms, like front, rear, back, upper, lower, above, sink, as well as broadness and depth refer to the mobile cooling box 1 standing on the ground as usually intended and from a perspective facing the side of the mobile cooling box 1 were the edge of the lid is pivotable to the above while opening, unless explicitly stated otherwise.

Figure 2:
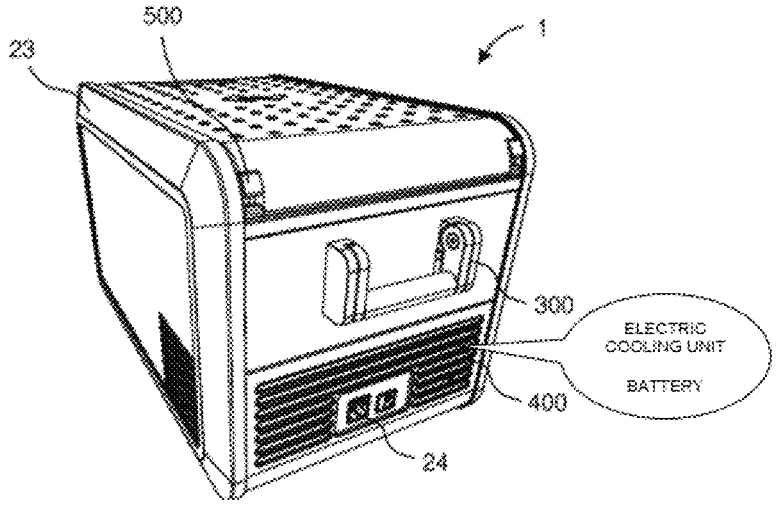
FIG. 2 shows a back-perspective view of the mobile cooling box of FIG. 1.
Figure 3:
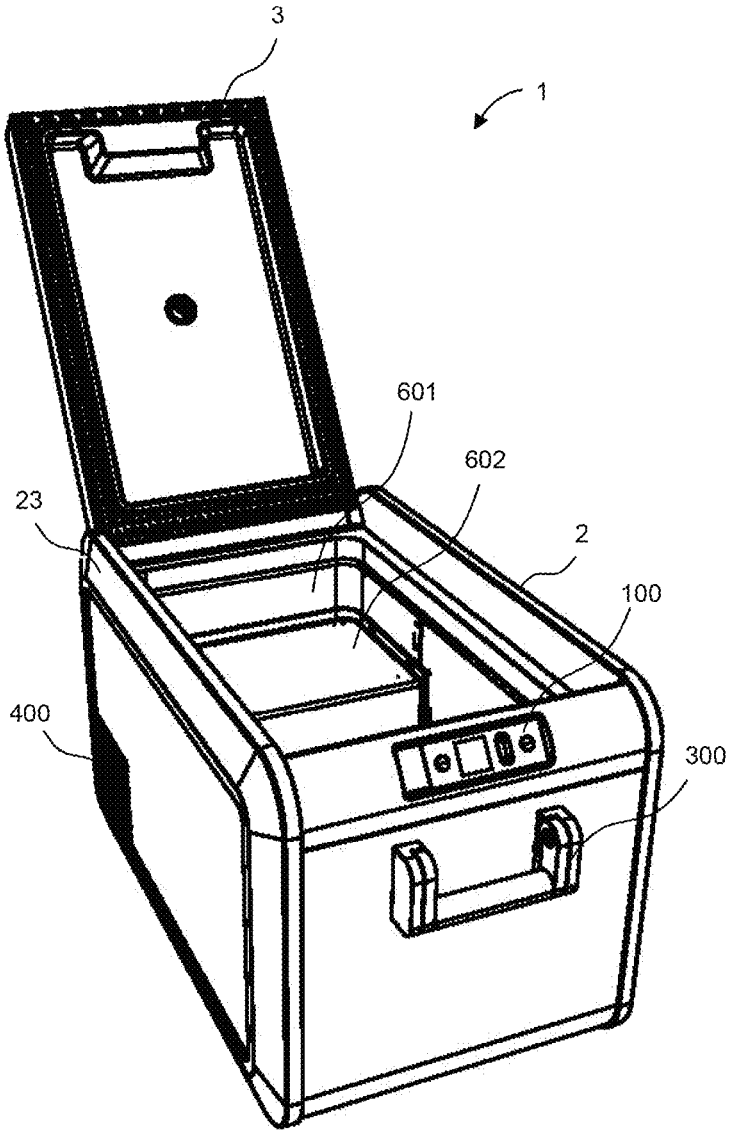
FIG. 3 shows the open mobile cooling box of FIG. 1.
Figure 4:
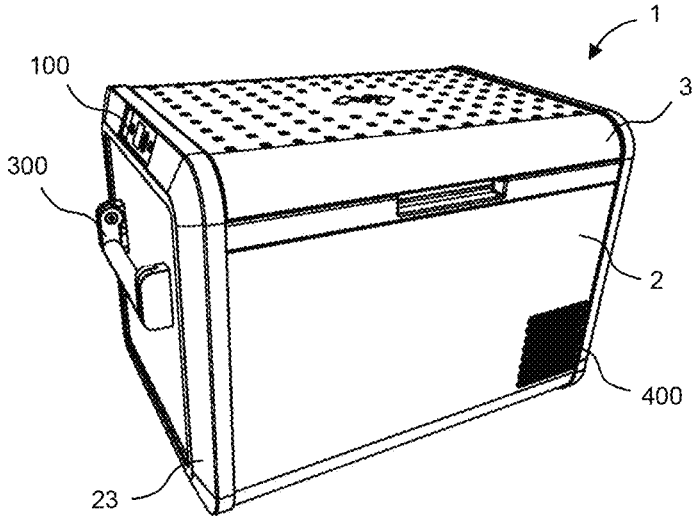
FIG. 4 shows a front perspective view of another mobile cooling box.
Figure 5:
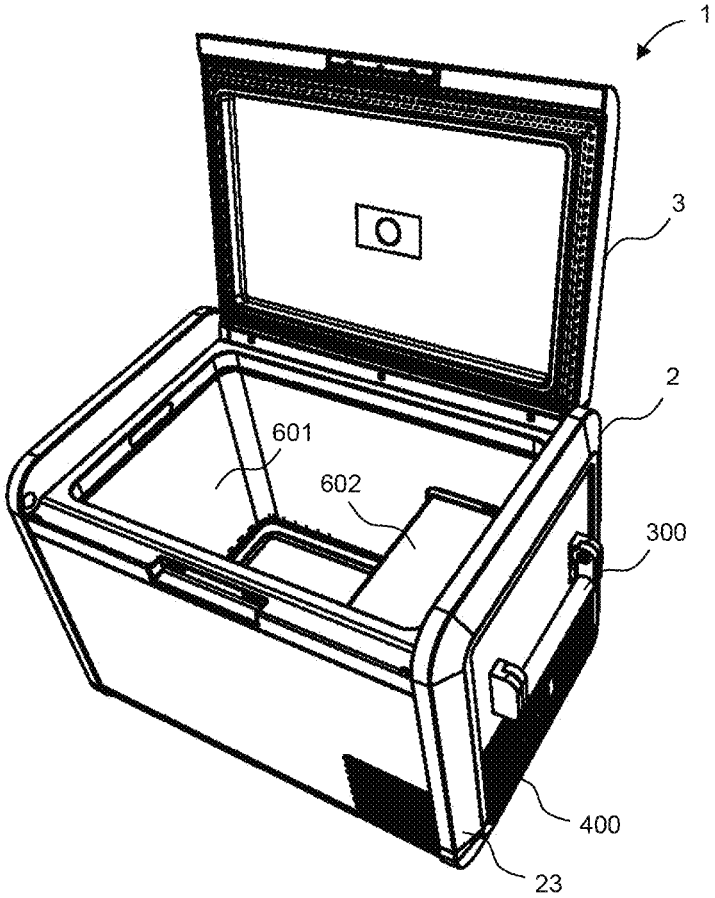
FIG. 5 shows the open mobile cooling box of FIG. 4.
Figure 6:
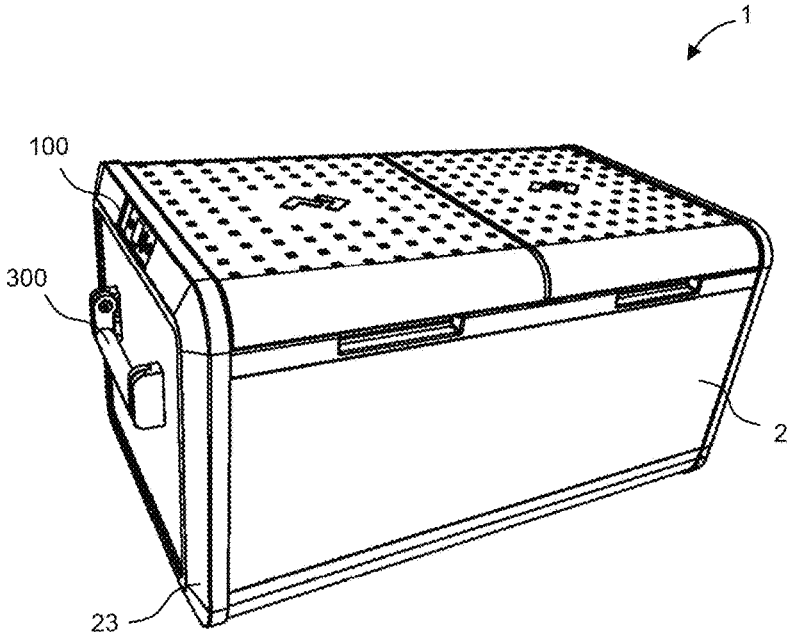
FIG. 6 shows a front perspective view of another mobile cooling box.
Figure 7:
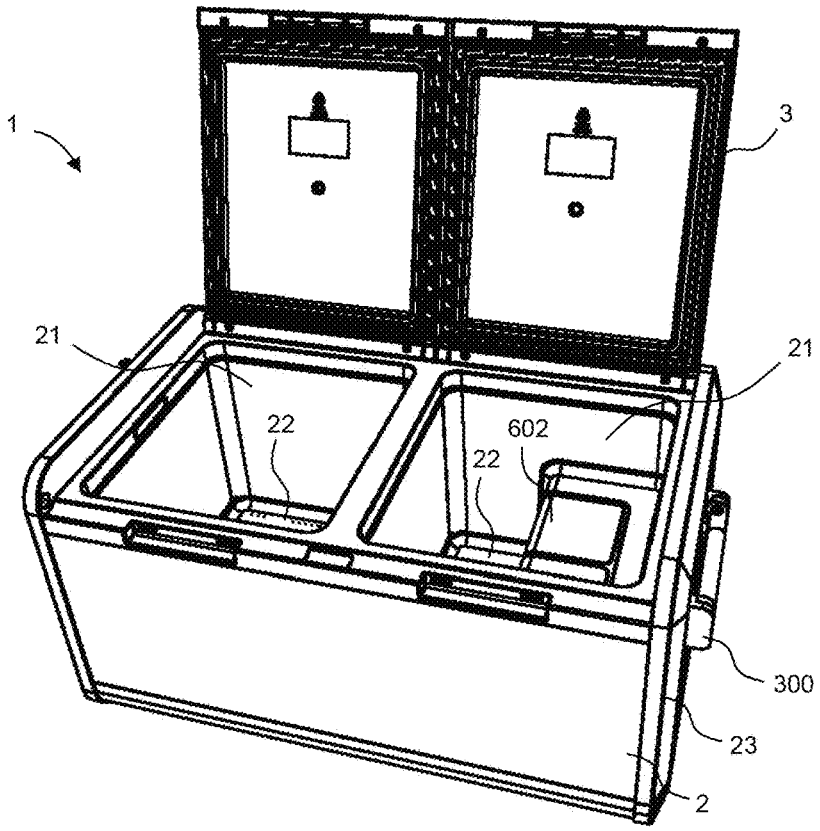
FIG. 7 shows the open mobile cooling box of FIG. 6.

Each illustrated mobile cooling box 1 is of different depth and width. The lid 3 or the lids 3 are to be opened from a side where the fender frame 23 is not located. This is in case of the mobile cooling box 1 of rather small size, as illustrated in FIGS. 1 to 3, the shorter side of the mobile cooling box 1. In case of the two mobile cooling boxes 1 of rather large size, as illustrated in FIGS. 4 and 5 and FIGS. 6 and 7, it is the longer side of the mobile cooling box 1, respectively.

The mobile cooling box 1 has an electrically driven cooling unit and comprises an internal battery (not shown). The mobile cooling box 1 can be used in plugged-in mode or in battery mode. The mobile cooling box 1, therefore, has the required sockets 24 located at one of its sides.

In the following, different aspects and features of the mobile cooling box are described. As will become apparent, many of the following aspects relate to readily mountable modules for various functions which can be mounted without limitation to the mobile cooling box 1 regardless of the size thereof.

Figure 8:
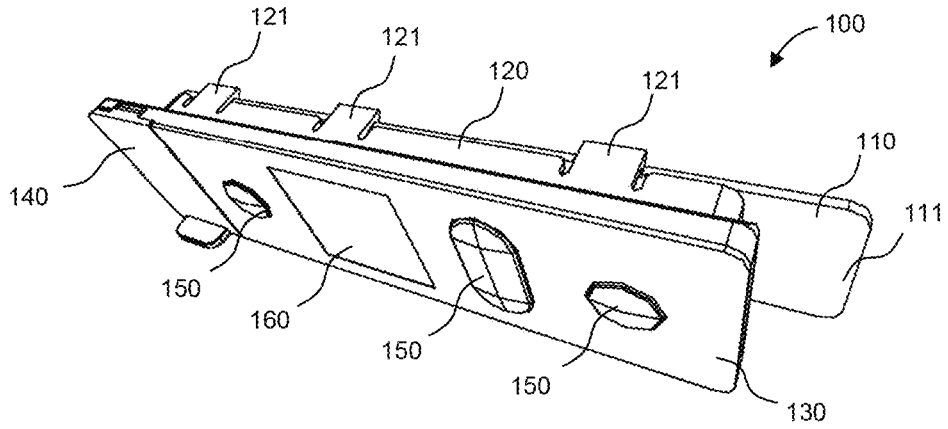
FIG. 8 shows an isolated perspective view of a user interface module.
Figure 9:
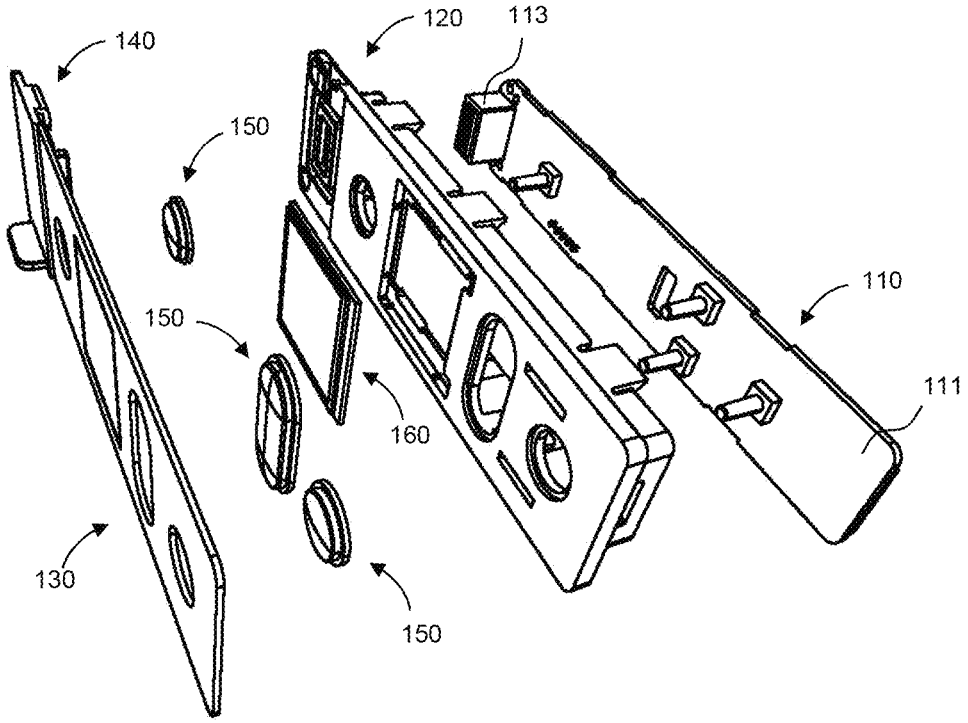
FIG. 9 shows an exploded view of the component of FIG. 8.
Figure 10:
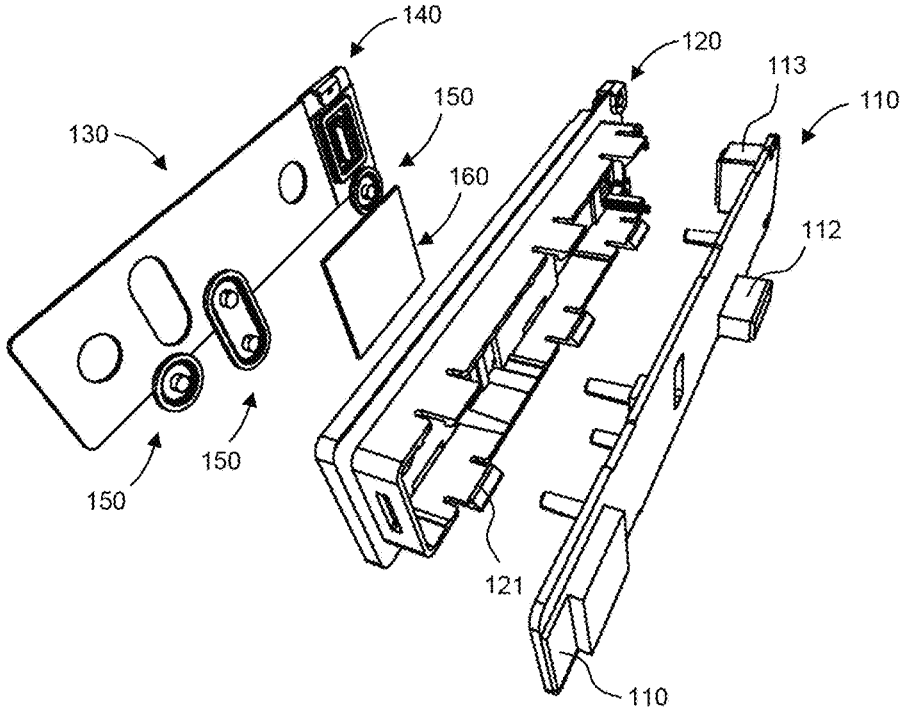
FIG. 10 shows another exploded view of the component of FIG. 8.

The FIGS. 8 to 10 show a user interface. With such a user interface it is possible for the user to sort of communicate with the mobile cooling box 1, that is, retrieving information from the mobile cooling box 1 and entering controls into the mobile cooling box 1. The mobile cooling box 1 is equipped with the user interface module 100 for operation and control by the user. The user interface module 100 is mounted at the mobile cooling box 1 in a way that a part of it is engaged with a designated opening at the mobile cooling box 1 on one side of the user interface module 100 and fixed with additional fixation structure at the other side of the user interface module 100, however other structures may be utilized. For example, as illustrated, screws 170 are used for fixing the module 100 at the left side. On the right side, no screw is necessary. At this side the module 100 is engaged with the designated opening at the mobile cooling box.

As shown in FIGS. 9 and 10, the user interface module 100 is an assembly of components, namely a circuit board 110, a housing 120 and a front cover 130. The assembly is mounted in a recessed part of the mobile cooling box 1 so that essentially only the front cover 130 is directly visible for the user.

The circuit board 110 forms a latch 111 extending away from the right side of the assembly with respect to the housing 120 and the front cover 130. The latch 111 is engaged with the designated opening at the mobile cooling box 1. The circuit board 110 is essentially longer in size than the housing 120 at the right side. The circuit board 110 extends over the edge of the housing 120 and the front cover 130. In the illustrated embodiment, the circuit board 110 extends over the edge of the housing 120 and the front cover 130 for about 1 cm, but also other dimensions are possible. At the backside of the circuit board 110 the part forming the latch 111 is further strengthened by additional material provided in this area.

As shown in FIG. 10, the circuit board 110 has a connector 112. The connector 112 is located at the backside of the circuit board 110. The user interface module 100 is electronically connected with the mobile cooling box 1 by using the connector 112. A respective plug (not shown) is provided in the inside of the box main body 2 of the mobile cooling box 1 and can be reached from the opening in which the user interface module 100 is hooked.

The user interface module 100 further has a USB port 113. In the illustrated embodiment a single USB port 113 is provided. However, there can be also a plurality of USB ports provided, for example depending on the size of the mobile cooling box. The USB port 113 is present at the circuit board 110. Moreover, two through holes for a screw connection are provided. By using the USB port 113 the user can recharge external devices like batteries, lamps, smartphones, etc. Moreover, the USB port 113 provides access to the internal control of the mobile cooling box 1 and, depending on the settings and version, enables download of internal data and/or programming of functions of the mobile cooling box 1.

The housing 120 is clamped onto or over the circuit board 110 by respective clip-in elements 121. In the shown example, three clip-in elements 121 on each of the upper and the lower side of the housing 120 are sufficient to achieve a stable and robust fixation of the housing 120. The housing 120 is formed of an injection molded plastic component. The housing provides co-injected regions of plastic that is softer than at other regions of the housing 120.

At the housing 120, the area of the USB port 113 is left open to allow access to the USB port 113. A rubber cap 140 is provided for covering the USB port 113 when not in use. In the present embodiments, the rubber cap 140 is swingably attached to the housing 120 to avoid losing the rubber cap 140. By removing the rubber cap 140 from the housing 120 access to the USB port 113 becomes possible. Here, the size and design of the rubber cap 140 ensures coverage of the through holes 121 provided for the screw connection at the same time.

The user interface module 100 further has a display 160, the display 160 is arranged behind the front cover 130 and the front cover 130 of the user interface module 100 is transparent at least in the area of the display 160.

The user interface module 100 further has three operation devices, here in the form of buttons 150 extending from the user interface module 100. One of the buttons 150 is located at the right side of the display 160 and provides an up-and-down selection button 150 for navigating through the menu of the control menu of the implemented software. In the illustrated embodiment, two further buttons 150, here designed in form of single round buttons, are provided at both sides next to the display 160, or, respectively, the afore-mentioned button 150. The buttons 150 are made of rubber, or covered by rubber, in order to provide good haptics and provide a stable and robust design.

The front cover 130 user interface module 100 is of a scratch resistant material or has a scratch resistant coating.

The user interface module 100 is capable of wireless communication with an external electronic device, for example by Bluetooth technology, WLAN or any other suitable technology. The external electronic device can be a remote control, a smartphone or the like. Hence, the user interface 100 and thus the mobile cooling box is remote controllable with the external electronic device. In case of using a smartphone, a respective app is available and to be used on the smartphone.

The user interface module 100 provides to the user functions and controls like ON/OFF-switching the cooling, temperature control including setting, if desired in a timeshift manner, displaying current temperature, temperature history graphs, temperature type setting (° C./° F.), alarm setting, energy saving mode, displaying battery status, including voltage level and/or battery remaining time, power consumption history graphs, lid 3 open indication, wireless communication ON/OFF and setting display brightness. The below list shall not be construed as conclusive. Further functions are, thus, also possible.

Figure 11:
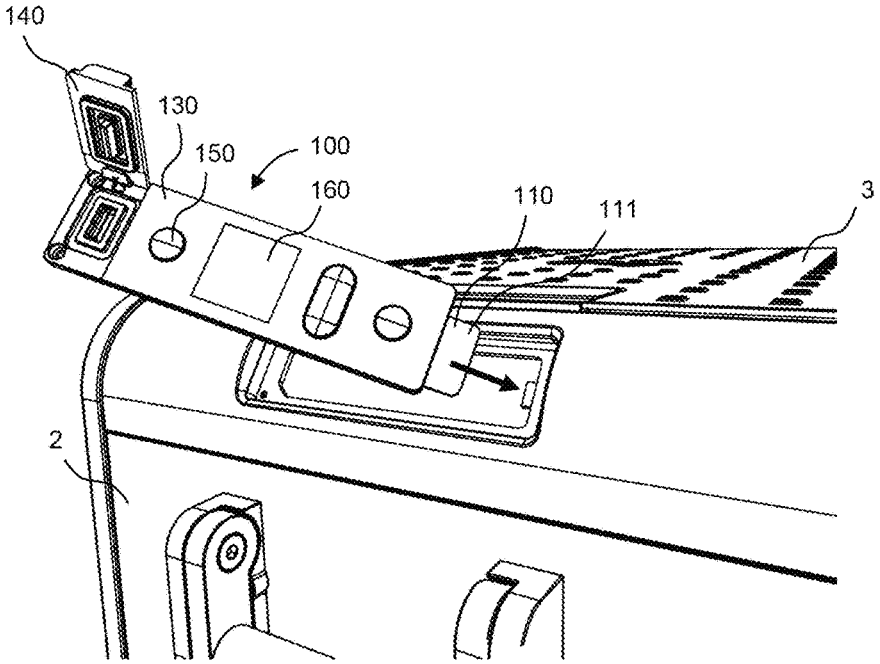
FIGS. 11 to 13 illustrate a sequence of a mounting procedure.
Figure 12:
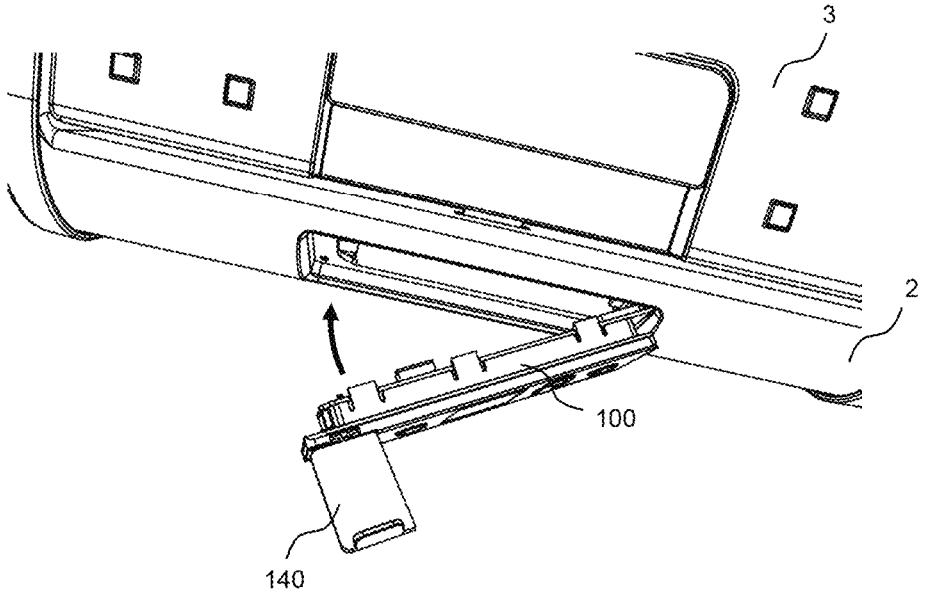
Figure 13:
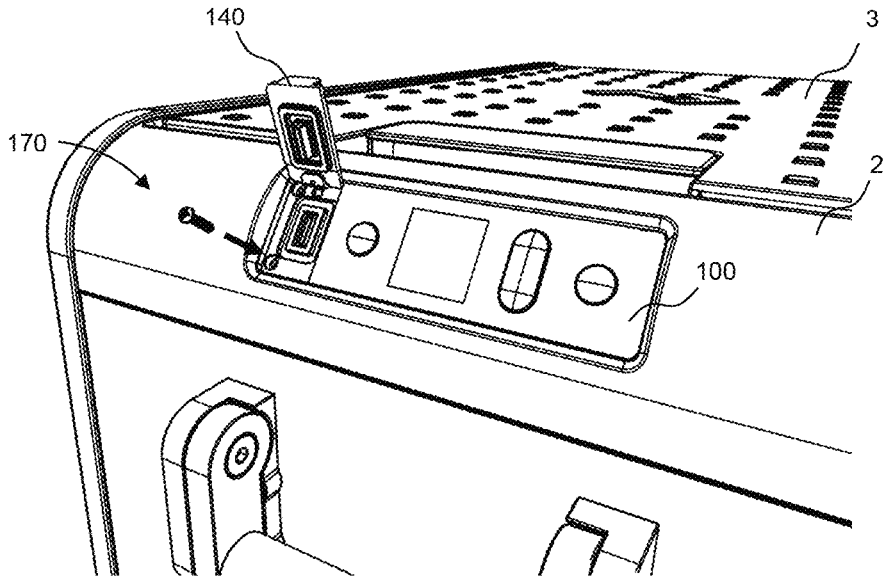
Figure 14:
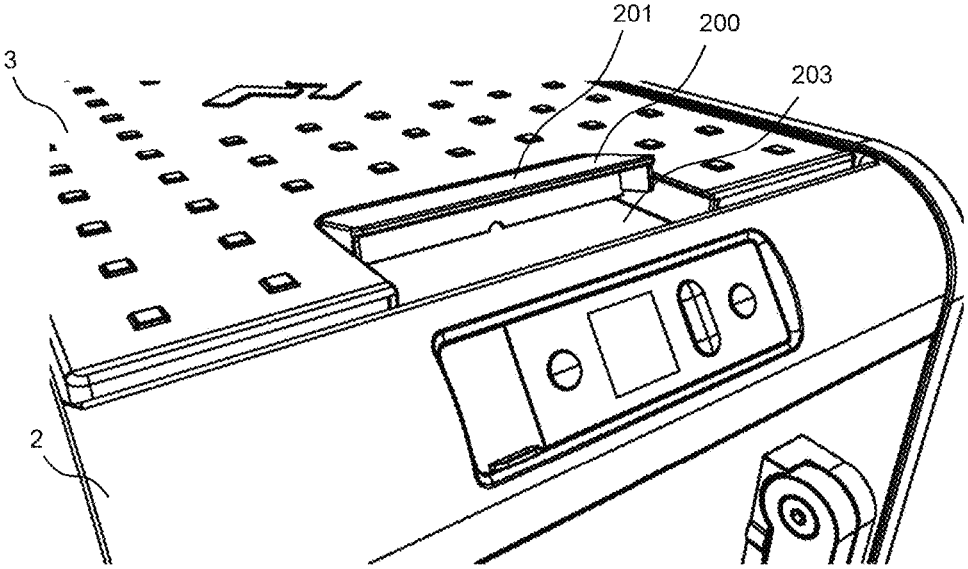
FIG. 14 shows a section of the mobile cooling box of FIG. 1 with actuated latch handle.
Figure 15:
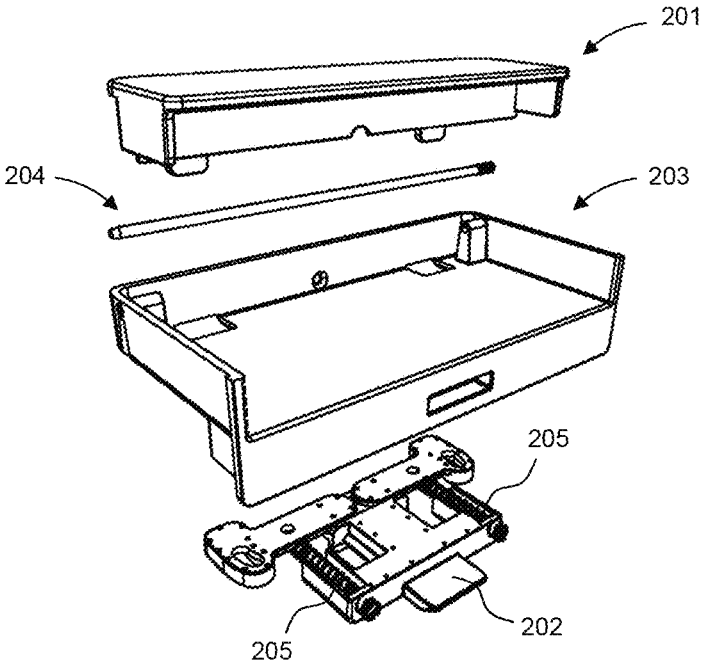
FIG. 15 shows an exploded view of the latch handle of FIG. 14.
Figure 16:
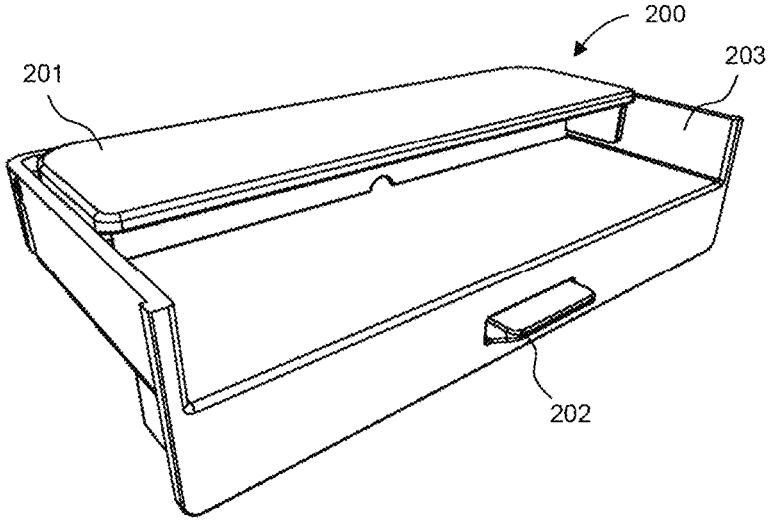
FIG. 16 shows an isolated perspective view of the latch handle of FIG. 14.

For mounting the user interface module 100, the part on the right side of the user interface module 100 that is supposed to be engaged with the designated opening at the mobile cooling box 1 is laterally slid into the designated opening. This step is illustrated in FIG. 11. In FIG. 11 the rubber cap 140 is shown in its open position. However, the rubber cap 140 itself is not involved in the inserting and assembling process of the user interface module 100. After being inserted with the latch 111, the left side of the user interface module 100 is rotated in place as shown in FIG. 12 and, in the next step, the user interface module 100 is fixed with two screws to complete the mounting process.

The mobile cooling box 1 according to some embodiments, and as described before, has at least one lid 3. By using the lid 3 the mobile cooling box 1 can be opened from one side-edge of the lid 3. Thereby, access is provided to the inside of the box 1. At the opposite side-edge of the lid 3, the lid 3 is hinged to the box main body 2. By this hinge connection the lid 3 can be pivoted upwards.

As shown in FIGS. 14 to 17, the mobile cooling box 1 is equipped with a latch handle module 200. The latch handle module 200 allows manually locking and unlocking of the lid 3 and, thus, opening and closing the mobile cooling box 1 by the lid 3. The latch handle module 200 is integrated in the lid 3 and located at the front side edge of the lid 3 of the illustrated embodiment of the mobile cooling box 1.

The latch handle module 200 is an assembly of components including an actuating element 201, a locking element 202 and a casing 203. The actuating element 201 is manually operable by the user. The locking element 202 is engageable with a corresponding counterpart at the box main body 2. By engaging the corresponding counterpart at the box main body 2 the lid 3 is locked from being opened.

Figure 17:
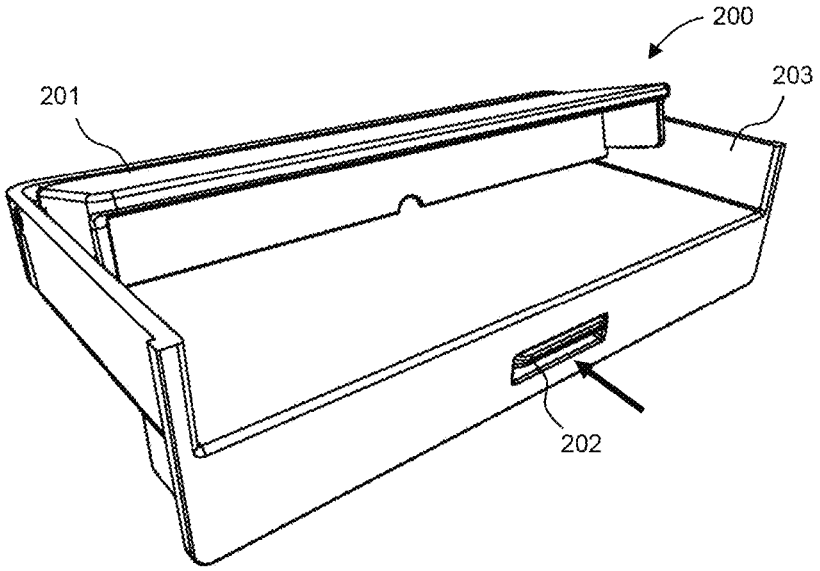
FIG. 17 illustrates the working principle of the latch handle of FIG. 14.

The latch handle module 200 provides a mechanism for locking and unlocking the lid 3. According to the latch handle module 200 the actuating element 201 and the locking element 202 are mechanically connected to each other. As illustrated in FIG. 17, by operating the actuating element 201, the locking element 202 disengages with its corresponding counterpart at the box main body 2 and allows up-folding the lid 3. In this embodiment, the locking element 202 is designed as a snap-in latch. The snap-in latch, in a closed state, extends into the corresponding counterpart being a recess in the box main body 2. Furthermore, the actuating element 201 has a surface which can be pushed by the fingers of the user's hand. In the illustrated embodiment the actuating element 201 has a width of about 10 cm. However, according to the overall size the width of the actuating element 201 can have also a different size. For opening the lid 3, the actuating element 201 is pivoted about an axis of rotation with a pivoting direction that is the same as that of the lid 3 when being opened. Therefore, there are no opposing movements for the user's hand, which has been found to be comfortable for the user.

As regards the working principle of the latch handle module 200, the latch handle module 200 further comprises a shaft 204. The shaft 204 has a longitudinal axis being co-linear with the axis of rotation of the actuating element 201. The actuating element 201 is connected to and pivotable about the shaft 204. The shaft 204 is of a rigid metal material and extends essentially over the entire width of the latch handle module 200. The latch handle module 200 further has two springs 205 by means of which the mechanism provided by the latch handle module 200 is spring loaded. The mechanism provided by the latch handle module 200 is spring loaded for providing a restoring force that ensures that the actuating element 201 and the locking element 202 return to their respective initial positions after an operation of the actuating element 201 by the user.

Figure 18:
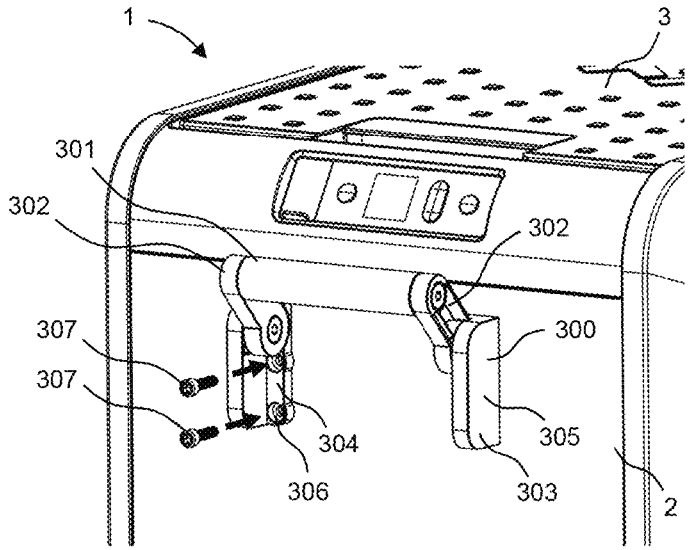
FIG. 18 illustrates the mounting procedure of a handle module.
Figure 19:
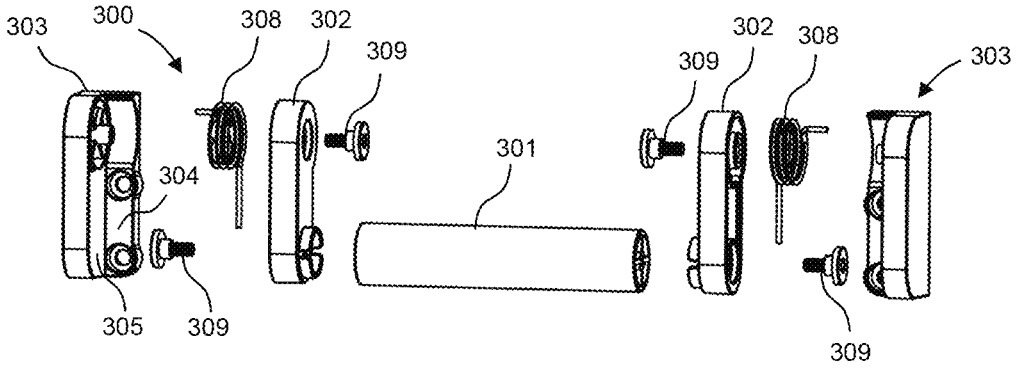
FIG. 19 shows an exploded view of the handle module of FIG. 18.

As shown in FIGS. 18 and 19, the mobile cooling box 1 is equipped with two handle modules 300. The two handle modules 300 are located at an outer side surface of the box main body 2. One handle module 300 has a handlebar 301. The handlebar 301 is intended to be grasped by the hand of the user and has a longitudinal axis as well as two ends, two hangers 302 and two brackets 303. The handlebar 301 is attached at its two ends to the two hangers 302. The hangers 302 are rotatably mounted at the two brackets 303. The two brackets are fixed to the outer side surface of the box main body 2.

The handle module 300 is designed in a way that the handle 301 hangs downwards in an unactuated state and can be swung out and upwards for carrying the mobile cooling box 1.

Each of the brackets 303 comprises a mounting area, or mount, 304 and a shielding area, or shield, 305. The mounting area 304 faces the outer side surface of the box main body 2 to which the bracket 303 is fixed. The shielding area 305 hides the hangers 302 and the handlebar 301 in an unactuated state of the handle module 300 and in a lateral perspective along the longitudinal axis of the handlebar 301.

The handle module 300 is designed so that, in an unactuated state of the handle module 300 and in a lateral perspective along the longitudinal axis of the handlebar 301, at least a section of the outer contour of the shielding area 305 is flush with the handlebar 301 and with the hangers 302. Thus, when the mobile cooling box 1 is not carried, the handlebar 301 with its hangers 302 exactly hides behind the bracket 303 in the respective lateral perspective.

The handlebar 301 and its hangers 302 are spring-loaded. Thus, in an unactuated state, the handlebar 301 and the hangers 302 are forced in a direction to the mobile cooling box 1 and are thus kept hidden in-between the shielding areas 305 of both brackets 303. For this purpose, two springs 308 are arranged within the handle module 300. The springs 308 force the hangers 302 relative to the brackets 303 to abut against the part with the mounting area 304.

The handle module 300 is designed in a way that, in an actuated state, the hangers 302 with the handlebar 301 are swung out and upwards and rest in a position relative to the mobile cooling box 1. Thus, the mobile cooling box 1 can be carried in a comfortable way. The hangers 302 with the handlebar 301 rest in the position by means of a region of the hangers 302 abutting against a region of the brackets 303. Thereby, at the joint between the brackets 303 and the hangers 302, the hangers are rounded in a section around the respective pivot axis. Moreover, a corresponding roundness is present at the brackets 303 to the extent that, when the hangers pivot out, the round part of the brackets 303 that enclose the round part of the hangers abut against the flanks of the hangers 302. Thus, further rotation of the hangers 302 is blocked.

Furthermore, at its mounting area 304 each bracket 303 comprises two through holes 306 for fixing the bracket 303 to the outer side surface of the box main body 2 by means of fixing elements 307, 309. In the illustrated embodiment of the mobile cooling box the fixing elements are designed in the form of screws but are not limited thereto. The through holes 306 and the respective fixing elements 307, 309 are covered by the hanger 302 that is mounted to said bracket 303, in an unactuated state of the handle module 300. Thereby, the hanger 302 abuts against said mounting area 304.

An additional accessory, like for example a bottle opener (not shown) or other equipment or tooling, can be attached at the through holes 306 by respective means, like for example screws.

As mentioned, the mobile cooling box 1 is basically rectangular in shape and has different dimensions in width and depth and height. Further, the two handle modules 300 are located at the respective two shorter outer side surfaces of the mobile cooling box 1 being opposite to each other. Thereby, when carrying the mobile cooling box 1 a tilting of the mobile cooling box 1 can be avoided.

In the present embodiment the handlebar 301 has a circular cross-section. Moreover, the handlebar 301 has a length of at least 10 cm to ease gripping the handlebar by the user's hand. However, other dimensions are also possible. The lower part of the hangers 302 correspond with this rounded contour. Also, the lower part of the brackets 303 partly correspond with this contour. Hence, the components are flush in an unactuated state.

At least the handlebar 301, the hangers 302 and the brackets 303 of the handle module 300 are made of aluminum. At least part of the surface of the aluminum is roughened and has an oxidic protective layer.

Figure 20:
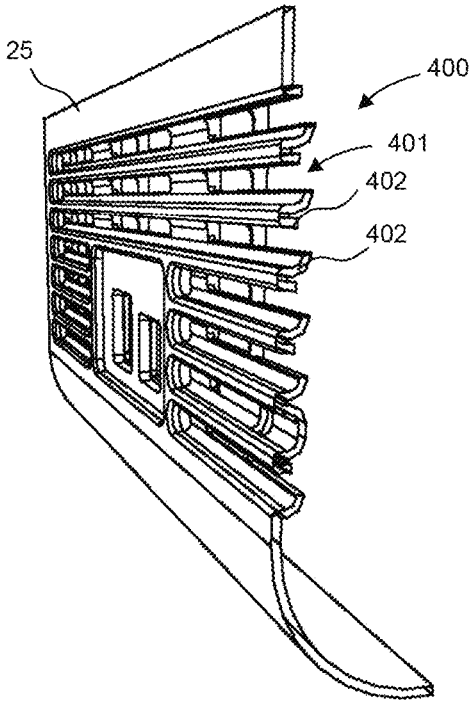
FIGS. 20 and 21 show different perspectives of a cut view of the outer side wall.
Figure 21:
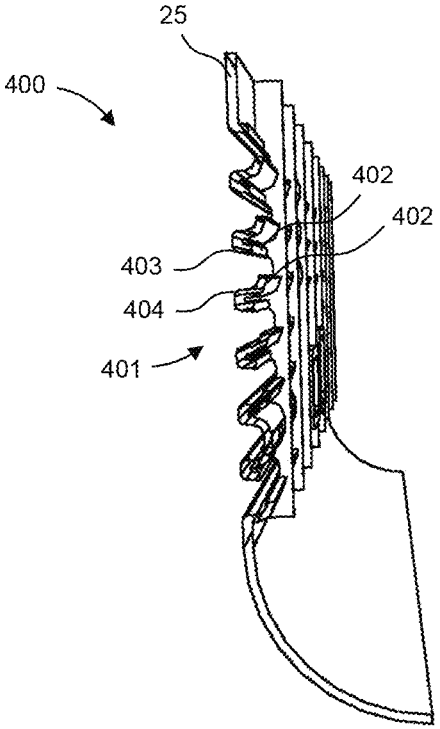
Figure 22:
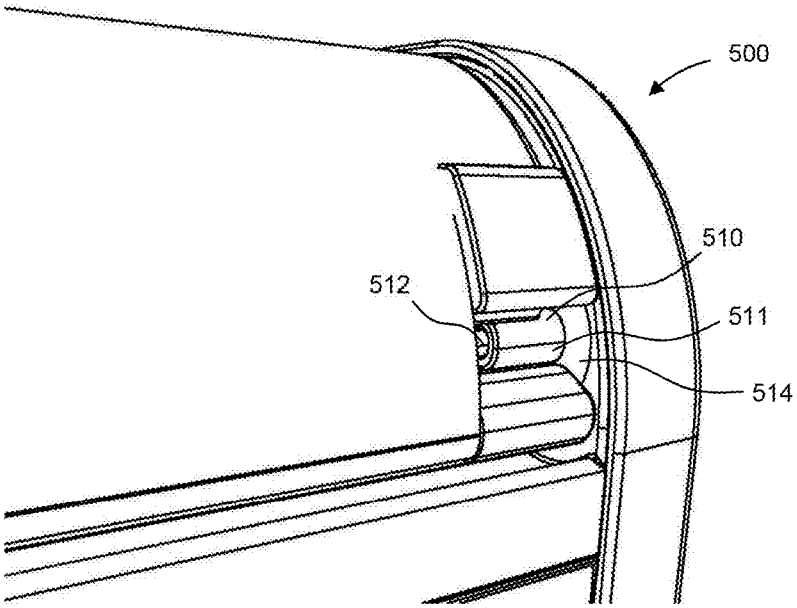
FIG. 22 shows a section of the mobile cooling box of FIG. 1 with a hinge module.
Figure 23:
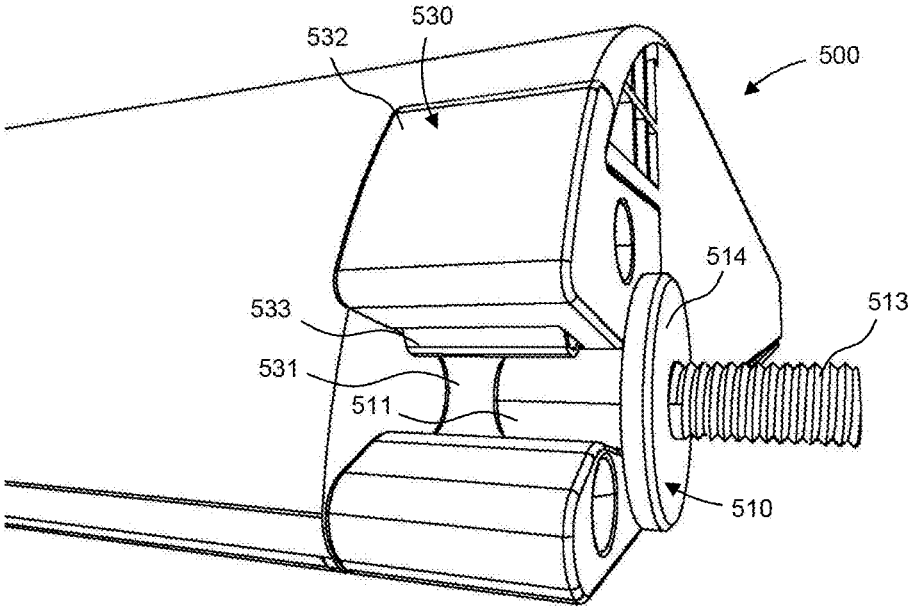
FIG. 23 shows relevant parts of FIG. 22.
Figure 24:
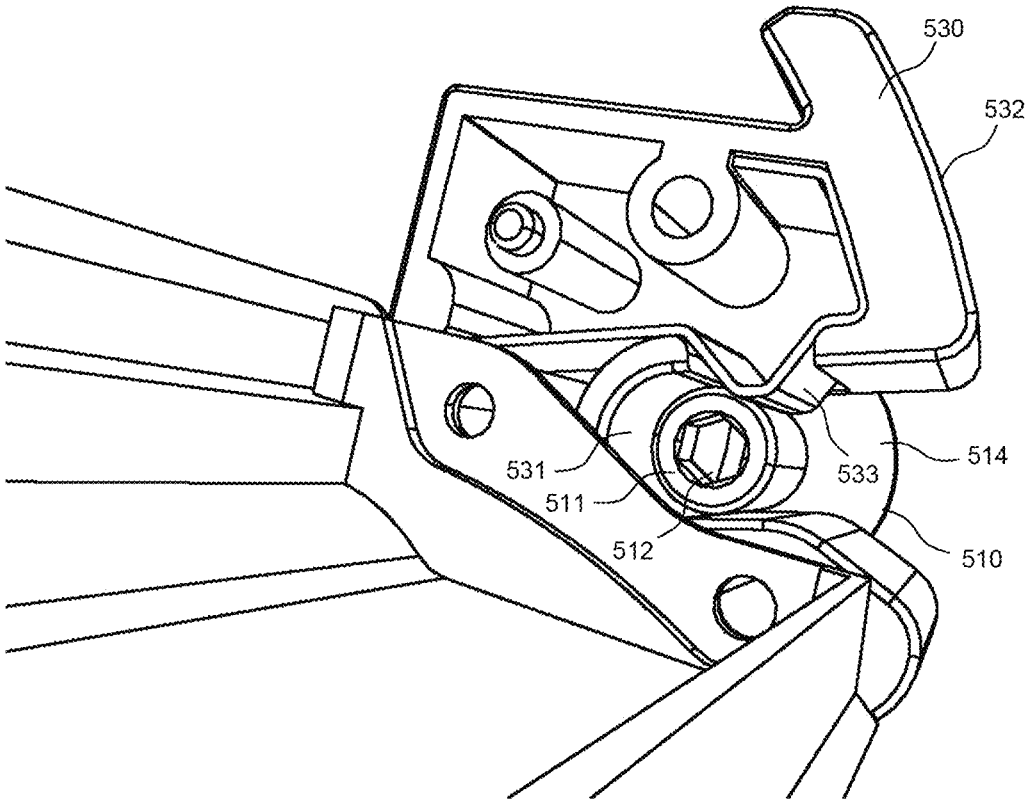
FIG. 24 shows an inside perspective view of the hinge module of FIG. 22.
Figure 25:
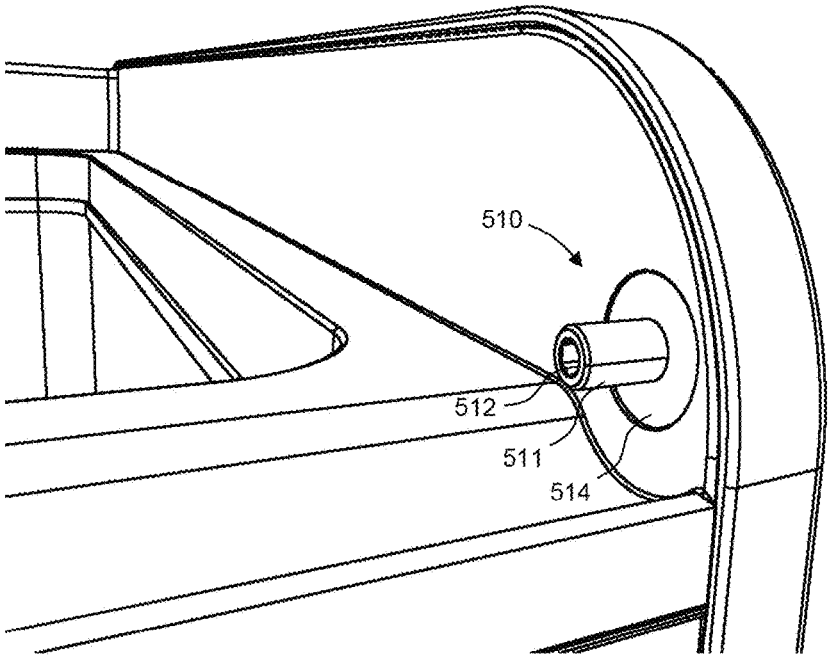
FIG. 25 shows a section of the mobile cooling box of FIG. 1 with removed lid.
Figure 26:
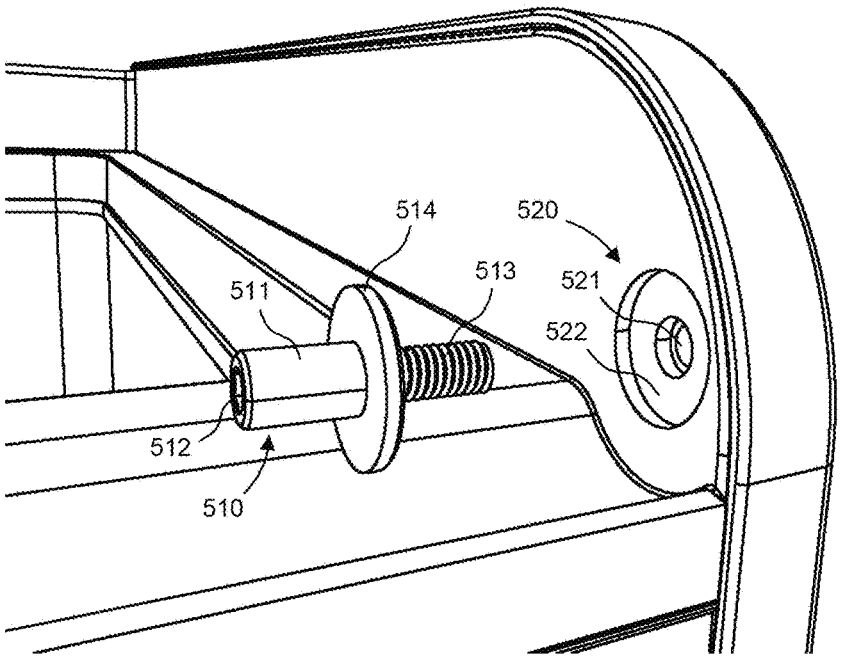
FIG. 26 shows the section of FIG. 25 and illustrates a mounting procedure.

As illustrated in FIGS. 20 and 21, the mobile cooling box 1 is equipped with air vents 400. The air vents 400 are located on at least one side wall 25 of the box main body 2. In the periphery of the air vents 400 cord fixation means are present (not shown). The electrical cord (not shown) provided for connecting the mobile cooling box to electrical power can be, especially in case the cord is not in use, attached to the outside of the mobile cooling box 1 in a known manner. The cord fixation means can for example be formed in the shape of hooks to which the cord can be removably attached. Nearby the air vents 400, as illustrated in FIG. 20, at least one power connector is present to connect the removable power cord (not shown) to the mobile cooling box 1 to supply electrical power to the mobile cooling box 1.

The air vents 400 comprise a plurality of horizontal opening or slots 401 (in the following generally referred to as slots), respectively, allowing air circulation through the respective side wall of the mobile cooling box 1. The slots 401 comprise shielding elements 402 protruding inside the mobile cooling box 1. Each of the shielding elements 402 is designed in such a way that the shielding element at least partly blocks the view into the inside of the mobile cooling box 1 from the outside. In other words, the inside of the mobile cooling box 1 is not visible from the outside due to the design of the shielding elements 402.

One slot 401 has an upper edge 403 and a lower edge 404. Both, the upper edge 403 and the lower edge 404 lie in the plane of the respective side wall. One of the shielding elements 402 extends from the lower edge 404 to the inside of the mobile cooling box 1 and further upwards with respect to said lower edge 404, virtually in the direction of and at least up to the height of the upper edge 402. Thus, the inside of the mobile cooling box 1 is not visible from the outside due to the design of the shielding element 402.

Particularly, in a vertical cross section perpendicular to said side wall, the shielding element 402 extends from the lower edge 404 in upward curved form, namely in the form of a segment of a circle.

Furthermore, one of the shielding elements 402 extends from the upper edge 403 to the inside of the mobile cooling box 1.

Particularly, in a vertical cross section perpendicular to said side wall, the shielding element 402 extends from the upper edge 403 to the inside of the mobile cooling box 1 in a straight horizontal direction. This has essentially the function of providing more stability to the side wall and to uniform the upper and lower edges 403 and 404 with regard to the roundness.

The side wall where the vents are present is manufactured together with the shielding elements 402 as a one-piece component which is made of plastic and manufactured by injection molding.

As is shown in FIGS. 22-26, the mobile cooling box 1 has a lid 3. The lid 3 is pivotally attached to the box main body 2 by means of two hinge modules 500. Each hinge module 500 comprises a pin module 510. The pin module 510 has a hinge pin 511 with a front end, a rear end, a longitudinal axis about which the lid 3 is pivotable, and a smooth outer surface having a cylindrical shape.

The hinge module 500 further comprises a bearing module 530. The bearing module 530 has a hinge bearing 531 accommodating the hinge pin 511. The hinge pin 511 laterally extends with its front end into the hinge bearing 531. Thus, during pivoting the lid 3 with respect to the box main body 2 an axis of the hinge bearing 531 remains co-linear with the longitudinal axis of the hinge pin 511.

For the mounting of the pin module 510, the pin module 510 further comprises an engaging portion 513, here in form of a bolt portion 513. The bolt portion 513 has a male thread and extends from the rear end of the hinge pin 511. The bolt portion 513 has a longitudinal axis being co-linear to that of the hinge pin 511.

The pin module 510 further comprises a backing plate 514 between the hinge pin 511 and the bolt portion 513. The backing plate 514 lies in a plane perpendicular to the longitudinal axis of the hinge pin 511 and has a pin-side surface and a bolt-side surface. The backing plate 514 has a circular shape so that it is symmetrical with regard to rotation.

The pin module 510 is mounted to the box main body 2 at a vertical surface thereof which is the inner sider of a part of the box main body 2. The backing plate 514 abuts with its bolt-side surface against said vertical surface of the box main body 2.

Furthermore, the vertical surface of the box main body 2 to which the pin module 510 is attached to has a pin module attachment portion 520. The pin module attachment portion 520 comprises a bore 521 having a female thread, in which the bolt portion 513 is fastened, and a recess 522 for accommodating the backing plate 514. The recess 522 has a depth corresponding to the thickness of the backing plate 514. Hence, the transition from said vertical surface of the box main body 2 to the surface of the pin-side surface of the backing plate 514 is flush. In order to provide for sufficient stability, the thickness of the backing plate 514 is about 2 mm.

Furthermore, the hinge pin 511 has a tool engagement portion 512 at its front end for fastening the pin module 510. The tool engagement portion 512 is a hexagonal socket that is engageable with a hex key at the front end face of the hinge pin 511. Moreover, the entire hinge pin 511 has a smooth outer surface of a cylindrical shape, so that the pivoting movement can be guided over the entire length of the hinge pin 511.

The entire pin module 510 including the hinge pin 511, the backing plate 514 and the bolt portion 513 is formed of metal. Moreover, the entire pin module 510 is formed as one single and integral component. Thus, the pin module 510 is very robust component.

The bearing module 530 is present at the lid 3 and the pin module 510 is present at the box main body 2. The hinge bearing 531 only partly envelops the hinge pin 511 and is open in a direction perpendicular to the longitudinal axis of the hinge pin 511. Thus, the bearing module 530 allows the hinge pin 511 to be released from the hinge bearing 531, thereby enabling the lid 3 to be removed completely from the box main body 2. In particular, when it is pivoted in an open direction for about 60° and more the lid 3 can be removed. Thus, the bearing module 530 is configured so that the lid 3 cannot be removed from the box main body 2 when the mobile cooling box 1 is closed.

The bearing module 530 further comprises a spring element 533. The spring element 533 protrudes out of an upper surface part of the hinge bearing 531. The spring element 533 is configured to hold the hinge pin 511 within the hinge bearing 531 and to provide a certain resistance during removing the lid 3 from the box main body 2.

The bearing module 530 further comprises an abutting portion 532. When the lid 3 is pivoted in the open direction for an angle of about 100° the abutting portion 532 abuts against a region of the box main body 2. Thereby, the lid 3 is enabled to rest in an open position.

Figure 27:
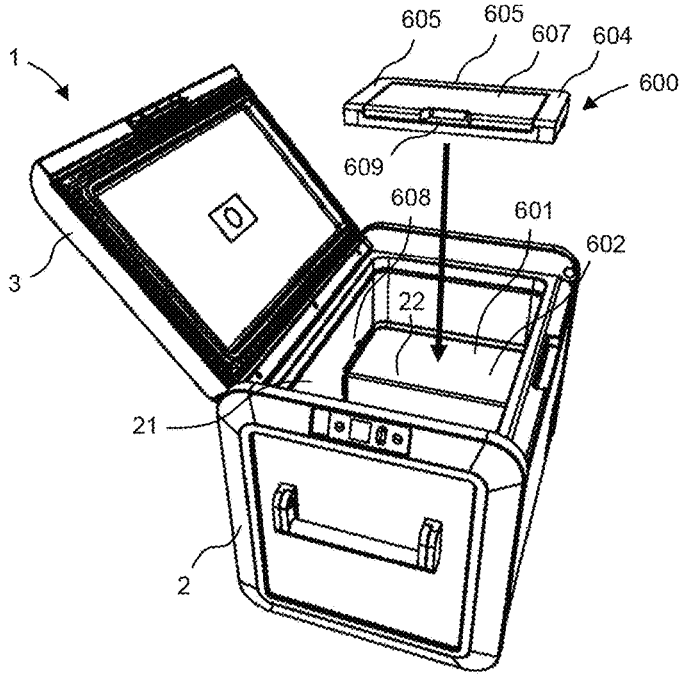
FIG. 27 illustrates the insertion of an ice maker module into the open mobile cooling box of FIG. 4.
Figure 28:
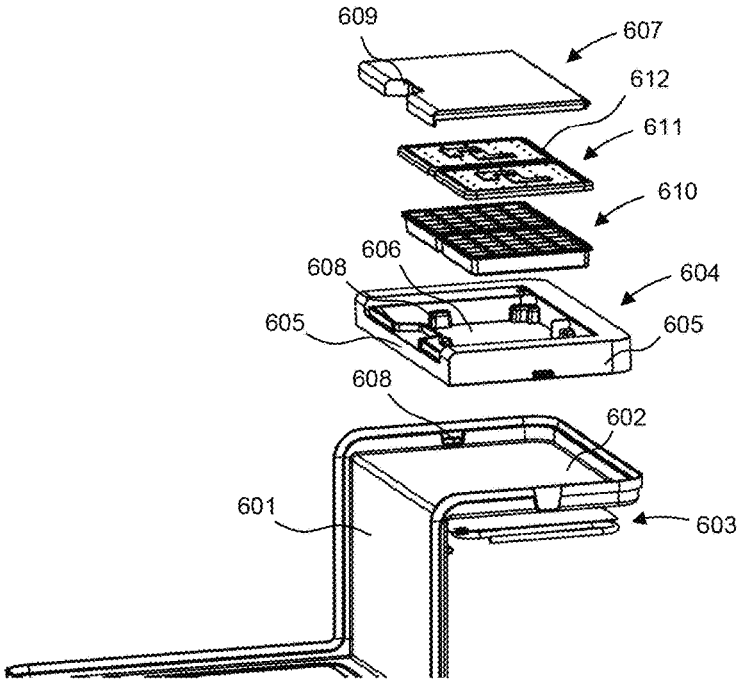
FIGS. 28 and 29 show different perspectives of an exploded view of the ice maker module.
Figure 29:
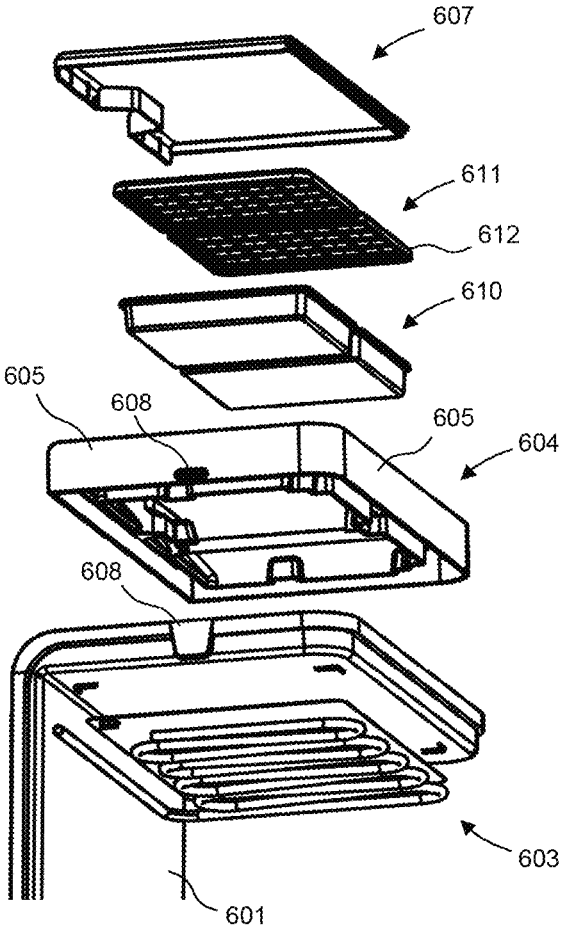

As shown in FIGS. 27 to 29 the mobile cooling box 1 has an inside that is laminated with a lining 601 at the inner side walls 21 and at the floor 22 of the box main body 2.

The mobile cooling box 1 is equipped with an ice maker module 600. The ice maker module 600 has a freezing compartment 606. The ice maker module 600 can be removably placed on a freezing zone 602 on a floor part of the lining 601.

The mobile cooling box 1 further comprises an evaporator 603 arranged underneath the lining 601 at the freezing zone 602, for providing sufficient cooling power for freezing goods.

The ice maker module 600 is an assembly of components, namely a frame 604 and a cover 607. The frame 604 has lateral walls 605 limiting the freezing compartment 606. The cover 607 is attached to the upper side of the frame 604 for opening and closing the ice maker module 600 and providing access from above to the freezing compartment 606. The freezing compartment 606 is limited at its ground by the lining 601 at the freezing zone 602. Thus, the goods to freeze are placed directly on the floor part of the freezing zone 602 for efficient freezing.

The freezing zone 602 is rectangular and is located in a niche limited by the lining 601 of three of the inner side walls 21. The ice maker module 600 fits in the niche.

At least one pair of corresponding attachment means 608 configured to releasably engage with each other is present at the lining 601 of the inner side walls 21 adjacent to the freezing zone 602 and at the ice maker module 600, respectively. By the at least one pair of corresponding attachment means 608 the position of the ice maker module 600 is secured. The pair of attachment means 608 provides for a form-locked connection being a snap-in connection. The snap-in connection consists of hook and a corresponding recess. The hook is a projecting element that is configured to snap in the recess. The hook is located at the ice maker module 600 and the corresponding recess is located at the lining 601 of the respective inner side wall 21. The hook is located at the frame 604 of the ice maker module 600.

The hook and the recess of one pair of corresponding attachment means 608 are formed as integral parts of the lining 601 and the ice maker module 600, respectively.

Furthermore, the cover 607 is hinged to the frame 604. Thus, the cover 607 is swingably openable to the above and can be opened about an angle of about 100°. The cover 607 has a grip portion 609 by means of which the cover 607 can be opened and closed by the hand of the user.

The ice maker module 600 further comprises two ice trays 610. The ice trays 610 fit into the freezing compartment 606. Each of the ice trays 610 is equipped with a cap 611. Each ice tray 610 has a plurality of recesses for forming ice cubes. The cap 611 has small holes 612 in form of bores with a rather small diameter. By these holes air exchange is enabled between inside and outside of the ice tray, but predominantly preventing water from leaking out.

The opening of the tiny holes has a cross section of about 0.20 mm. Above each recess, one of the tiny holes is arranged.

Figure 30:
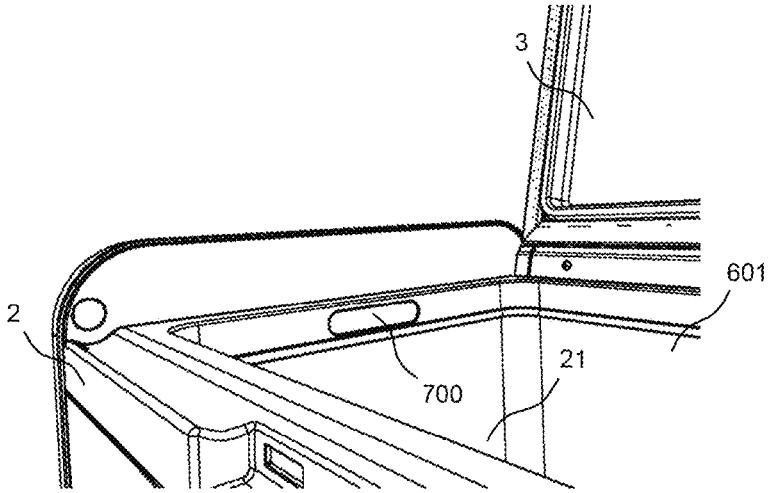
FIG. 30 shows a section of the open mobile cooling box of FIG. 4 with a lamp system.

As shown in FIG. 30 the mobile cooling box 1 comprises a lamp module 700. By the lamp module 700 light can be provided in the inside of the box main body 2. To turn on the lamp module 700 it does not have any mechanical switches as in usual refrigerators. In the present embodiment, the lamp module 700 can be switched ON or OFF by means of a reed sensor (not shown). The front cover of the lamp module 700 is perfectly flush with the surface at which the lamp module 700 is arranged.

The front cover is mounted to the inner lining in a waterproof manner. Specifically, the front cover of the lamp module 700 is clipped in a corresponding recessed part of the inner lining and is equipped with sealed portions.

Furthermore, the front cover of the lamp module 700 is transparent and provides a diffuse light. The light is emitted from diodes inside the lamp module 700 and both, the light-emitting diodes and the reed sensor are mounted on a circuit board of the lamp module 700.

For switching the light ON and OFF, a magnet is incorporated in the part of the lid 3 that functionally corresponds with the reed sensor. In the closed state of the lid 3, the magnet is located in the vicinity of the light module 700 so that the light module is switch OFF. While opening or in the opened state the distance of the magnet, thus, is increased and the light module is switch ON by the reed sensor.

The invention claimed is:

1. A mobile cooler, comprising:

a box main body having a bottom and a plurality of walls extending from said bottom, said box main body having an interior, said interior defined within a plurality of inner side walls and a floor;

a lid pivotally connected to said box main body and allowing access to said interior;

at least one moveable handle on each of two opposed walls of said plurality of walls;

an electrically driven cooling unit having at least one socket for plugged in operation and a user interface disposed on an exterior of said mobile cooler to control said electrically driven cooling unit;

an evaporator disposed within said box main body and hidden by said plurality of inner side walls and said floor;

said floor having a first lower elevation and a second higher elevation, at least a portion of said evaporator disposed adjacent to said second higher elevation, one or more vents located in each of two walls of said plurality of walls adjacent to said second higher elevation in said interior;

an ice maker module disposed above said at least a portion of said evaporator disposed adjacent to said second higher elevation, said ice maker module having a cover which opens to access formed ice therein.

2. The mobile cooler of claim 1, said ice maker module having a frame, said cover pivotally connected to said frame.

3. The mobile cooler of claim 1 further comprising a freezing zone, said ice maker module disposed at said freezing zone.

4. The mobile cooler of claim 1, said plurality of walls comprising two long walls and two short walls.

5. The mobile cooler of claim 4, said lid pivoting relative to said box main body along one long wall of said two long walls, or one short wall of said two short walls.

6. The mobile cooler of claim 5, said lid comprising two lids.

7. The mobile cooler of claim 6, said two lids pivoting along said one long wall of said two long walls.

8. The mobile cooler of claim 1, further comprising a lining disposed along said floor.

9. A mobile cooler, comprising:

a main body having a plurality of walls and a bottom, said plurality of walls extending from said bottom, each of said plurality of walls defining an upper edge;

said plurality of walls each having an exterior and inner side wall, and said bottom having a floor, said inner side wall and said bottom defining and interior of said main body;

a lid pivotally connected to said main body, a pivot axis of said lid extending adjacent to said upper edge of one of said plurality of walls;

said floor having a first lower elevation and a second higher elevation, said second higher elevation located adjacent to one or move vents disposed in said exterior of said plurality of walls;

an electrically driven cooling unit disposed within said main body adjacent to said one or more vents, said electrically driven cooling unit in fluid communication with an evaporator, at least a portion of said evaporator disposed beneath said floor with said second higher elevation;

a freezing zone disposed above said floor of said second higher elevation;

an ice maker module disposed at said freezing zone, said ice maker module having a cover which may be opened to access ice formed therein.

10. The mobile cooler of claim 9, further comprising a user interface disposed in said main body.

11. The mobile cooler of claim 10, said user interface controlling said electrically driven cooling unit.

12. The mobile cooler of claim 9, further comprising a socket for plugged in operation of said electrically driven cooling unit.

13. The mobile cooler of claim 9 further comprising a movable handle on each of two opposed walls of said plurality of walls.

14. The mobile cooler of claim 13, said movable handle being spring biased to one of at least two positions.

* * * * *